US010954927B2

(12) United States Patent
Kharpas et al.

(10) Patent No.: US 10,954,927 B2
(45) Date of Patent: Mar. 23, 2021

(54) HYDRAULIC PUMP CONTROL SYSTEM

(71) Applicant: EATON INTELLIGENT POWER LIMITED, Dublin (IE)

(72) Inventors: Anil Balasaheb Kharpas, Maharashtra (IN); Robert Leslie Isaacs, Buffalo, MN (US); Avinash Dadaso Patil, Maharashtra (IN); Amit Ranjit Panchal, Maharashtra (IN); Yogiraj Firake, Maharashtra (IN); Anil Ghegade, Maharashtra (IN)

(73) Assignee: EATON INTELLIGENT POWER LIMITED, Dublin (IE)

( * ) Notice: Subject to any disclaimer, the term of this patent is extended or adjusted under 35 U.S.C. 154(b) by 349 days.

(21) Appl. No.: 15/776,365

(22) PCT Filed: Nov. 14, 2016

(86) PCT No.: PCT/US2016/061873

§ 371 (c)(1),
(2) Date: May 15, 2018

(87) PCT Pub. No.: WO2017/083839

PCT Pub. Date: May 18, 2017

(65) Prior Publication Data

US 2020/0256326 A1 Aug. 13, 2020

(30) Foreign Application Priority Data

Nov. 15, 2015 (IN) ..... 3720/DEL/2015
Nov. 15, 2015 (IN) ..... 3721/DEL/2015

(51) Int. Cl.
*F04B 1/324* (2020.01)
*F04B 49/00* (2006.01)
(Continued)

(52) U.S. Cl.
CPC ..... *F04B 1/324* (2013.01); *F04B 49/002* (2013.01); *F04B 1/2078* (2013.01); *F04B 49/08* (2013.01);
(Continued)

(58) Field of Classification Search
CPC ..... F04B 1/2078; F04B 1/2085; F04B 1/324; F04B 49/002; F04B 49/008; F04B 53/10; F15B 13/0402; F15B 2211/20553
See application file for complete search history.

(56) References Cited

U.S. PATENT DOCUMENTS 4,375,942 A * 3/1983 Olson ..... F04B 49/06 417/222.1
6,725,658 B1 * 4/2004 Lemmen ..... F04B 1/324 60/443
(Continued)

FOREIGN PATENT DOCUMENTS

DE 196 53 165 C1 4/1998
DE 10 2012 214 372 A1 9/2013
(Continued)

OTHER PUBLICATIONS

International Search Report and Written Opinion of the International Searching Authority for corresponding International Patent Application No. PCT/US2016/061873 dated Feb. 28, 2017, 9 pages.
(Continued)

*Primary Examiner* — Patrick Hamo
*Assistant Examiner* — Joseph S. Herrmann
(74) *Attorney, Agent, or Firm* — Merchant & Gould P.C.

(57) ABSTRACT

A hydraulic pump system includes a pump control system operable to reduce electric current required at the start of the pump and reduce starting torque for the pump. The pump control system can include a gap between a spring seat and a valve spool such that the valve spool need not overcome
(Continued)

a biasing force from a swash plate when the swash plate changes from its maximum displacement position to its neutral position.

20 Claims, 19 Drawing Sheets

(51) Int. Cl.

| | |
|---|---|
| *F04B 1/2078* | (2020.01) |
| *F04B 49/08* | (2006.01) |
| *F04B 53/10* | (2006.01) |
| *F15B 13/04* | (2006.01) |

(52) U.S. Cl.
CPC ..... *F04B 53/10* (2013.01); *F15B 13/0402* (2013.01); *F15B 2211/20553* (2013.01)

(56) References Cited

U.S. PATENT DOCUMENTS

| | | | | |
|---|---|---|---|---|
| 9,562,606 | B2 * | 2/2017 | Krittian | F04B 1/30 |
| 10,100,817 | B2 * | 10/2018 | Diebold | F01B 3/007 |
| 2006/0254269 | A1 | 11/2006 | Blum et al. | |
| 2009/0288552 | A1 | 11/2009 | Beck et al. | |
| 2010/0199838 | A1 | 8/2010 | Krebs et al. | |
| 2014/0000449 | A1 | 1/2014 | Brehmer et al. | |
| 2014/0130661 | A1 | 5/2014 | Howind et al. | |
| 2015/0152730 | A1 * | 6/2015 | Diebold | F01B 3/0055 91/473 |

FOREIGN PATENT DOCUMENTS

| | | |
|---|---|---|
| EP | 1 220 990 B1 | 11/2005 |
| JP | 53140103 A | 12/1978 |
| JP | 06288339 A | 10/1994 |

OTHER PUBLICATIONS

Extended European Search Report for corresponding European Patent Application No. 16865219.6 dated Apr. 2, 2019, 5 pages.
Notice of Reasons for Rejection, Japanese Patent Application No. 2018-525411, dated Nov. 27, 2020, 9 pages.

* cited by examiner

HYDRAULIC PUMP CONTROL SYSTEM

CROSS-REFERENCE TO RELATED APPLICATIONS

This application is a National Stage Application of PCT/US2016/061873, filed on Nov. 14, 2016, which claims the benefit of Indian Patent Application Serial No. 3720/DEL/2015, filed on Nov. 15, 2015, and claims the benefit of Indian Patent Application No. 3721/DEL/2015, filed on Nov. 15, 2015, the disclosures of which are incorporated herein by reference in their entireties. To the extent appropriate, a claim of priority is made to each of the above disclosed applications.

BACKGROUND

Hydraulic systems are used to transfer energy using hydraulic pressure and flow. A typical hydraulic system includes one or more hydraulic pumps for converting energy/power from a power source (e.g., an electric motor, a combustion engine, etc.) into hydraulic pressure and flow used to provide useful work at a load, such as an actuator or other devices. A hydraulic pump typically includes a rotor defining cylinders and pistons reciprocating within the cylinders. An input shaft is coupled to the rotor and supplies torque for rotating the rotor. As the rotor rotates about a central axis of the input shaft, the pistons reciprocate within the cylinders of the rotor, causing hydraulic fluid to be drawn into an input port of the pump and discharged from an output port of the pump. In a variable displacement pump, the volume of fluid discharged by the pump for each rotation of the rotor (i.e., the displacement volume of the pump) can be varied to match hydraulic pressure and flow demands corresponding to the load. Typically, the displacement volume of a pump is varied by varying the stroke length of the pistons within their respective cylinders.

One example of the variable displacement pump is disclosed in U.S. Pat. No. 6,725,658 titled ADJUSTING DEVICE OF A SWASHPLATE PISTON ENGINE. In the disclosure, an adjusting device is provided for adjusting a swash plate of an axial piston engine with a swash plate construction. The adjusting device includes a control valve inserted into a bore of a pump housing and an actuator defining a control force for a valve piston of the control valve. The actuator can include a solenoid. As the control force exerted by the actuator on the valve piston increases or decreases, a new equilibrium point results between the control force exerted by the actuator and a counter force exerted by a readjusting spring.

SUMMARY

In general terms, this disclosure is directed to a control system for a hydraulic pump. In one possible configuration and by non-limiting example, the control system is configured to reduce electric current required at the start of the pump, thereby reducing starting torque for the pump. Various aspects are described in this disclosure, which include, but are not limited to, the following aspects.

One aspect is a hydraulic pump system including a variable displacement pump and a control system. The variable displacement pump includes a pump housing defining a case volume having a case pressure, a system outlet, a rotating group mounted within the pump housing, and a swash plate. The rotating group includes a rotor defining a plurality of cylinders, and a plurality of pistons configured to reciprocate within the cylinders as the rotor is rotated about an axis of rotation to provide a pumping action that directs hydraulic fluid out the system outlet and provides a system outlet pressure. The swash plate is configured to be pivoted relative to the axis of rotation to vary stroke length of the pistons and a displacement volume of the pump. The swash plate is movable between a first pump displacement position and a second pump displacement position. The swash plate is biased toward the first pump displacement position. The control system operates to control a pump displacement position of the swash plate. The control system is at least partially mounted within a bore of the pump housing. The bore has a longitudinal axis. The control system includes a control piston and a control valve assembly. The control piston assembly includes a piston guide tube having a first tube end and a second tube end and extending between the first and second tube ends along the longitudinal axis within the bore and defining a hollow portion within the piston guide tube. The control piston assembly further includes a control piston at least partially mounted in the bore and movable along the longitudinal axis. The control piston has a first piston end adapted to receive a biasing force from the swash plate and a second piston end adapted to receive a displacement control force generated by a control pressure that acts on the second piston end of the control piston. The biasing force and the displacement control force are in opposite directions along the longitudinal axis. The control piston includes a piston hole defined therewithin and at least partially receiving the piston guide tube to define a case pressure chamber with the hollow portion of the piston guide tube. The case pressure chamber is in fluid communication with the case volume. The control valve assembly controls the control pressure supplied to the second piston end of the control piston. The control valve assembly is operable to enable the second piston end of the control piston to be selectively in fluid communication with the case volume and the system output. The control system further includes a valve actuation system controlling the control valve assembly, which may provide a pilot pressure.

Another aspect is a variable displacement pump system including a variable displacement pump and a control system. The variable displacement pump includes a pump housing defining a case volume having a case pressure, a system outlet having a system pressure, a rotating group mounted within the pump housing, and a swash plate. The rotating group includes a rotor defining a plurality of cylinders, and a plurality of pistons configured to reciprocate within the cylinders as the rotor is rotated about an axis of rotation to provide a pumping action that directs hydraulic fluid out the system outlet and provides a system pressure. The swash plate is configured to be pivoted relative to the axis of rotation to vary stroke length of the pistons and a displacement volume of the pump. The swash plate is movable between a maximum displacement position and a minimum displacement position. The swash plate is biased toward the maximum displacement position. The control system includes a control piston assembly and a control valve assembly. The control piston assembly includes a control piston axially movable. The control piston has a first piston end adapted to receive a biasing force from the swash plate and a second piston end adapted to receive a displacement control force generated by a control pressure that acts on the second piston end of the control piston. The biasing force and the displacement control force are in opposite directions along the longitudinal axis. The control valve assembly is movable to a first valve position, a second valve position, and a third valve position. In the first valve position, the second piston end of the control piston is in fluid communication with the case volume. In the second valve position, the second piston end of the control piston is in fluid communication with the system pressure such that the control pressure applied on the second piston end of the control piston increases to move the control piston against the biasing force of the swash plate, thereby moving the swash plate toward the minimum displacement position. In the third valve position, the second piston end of the control piston is in fluid communication with the case volume such that the control pressure applied on the second piston end of the control piston decreases to permit the biasing force of the swash plate to move the control piston back.

The above features and advantages and other features and advantages of the present teachings are readily apparent from the following detailed description for carrying out the present teachings when taken in connection with the accompanying drawings.

DETAILED DESCRIPTION

Figure 1A:
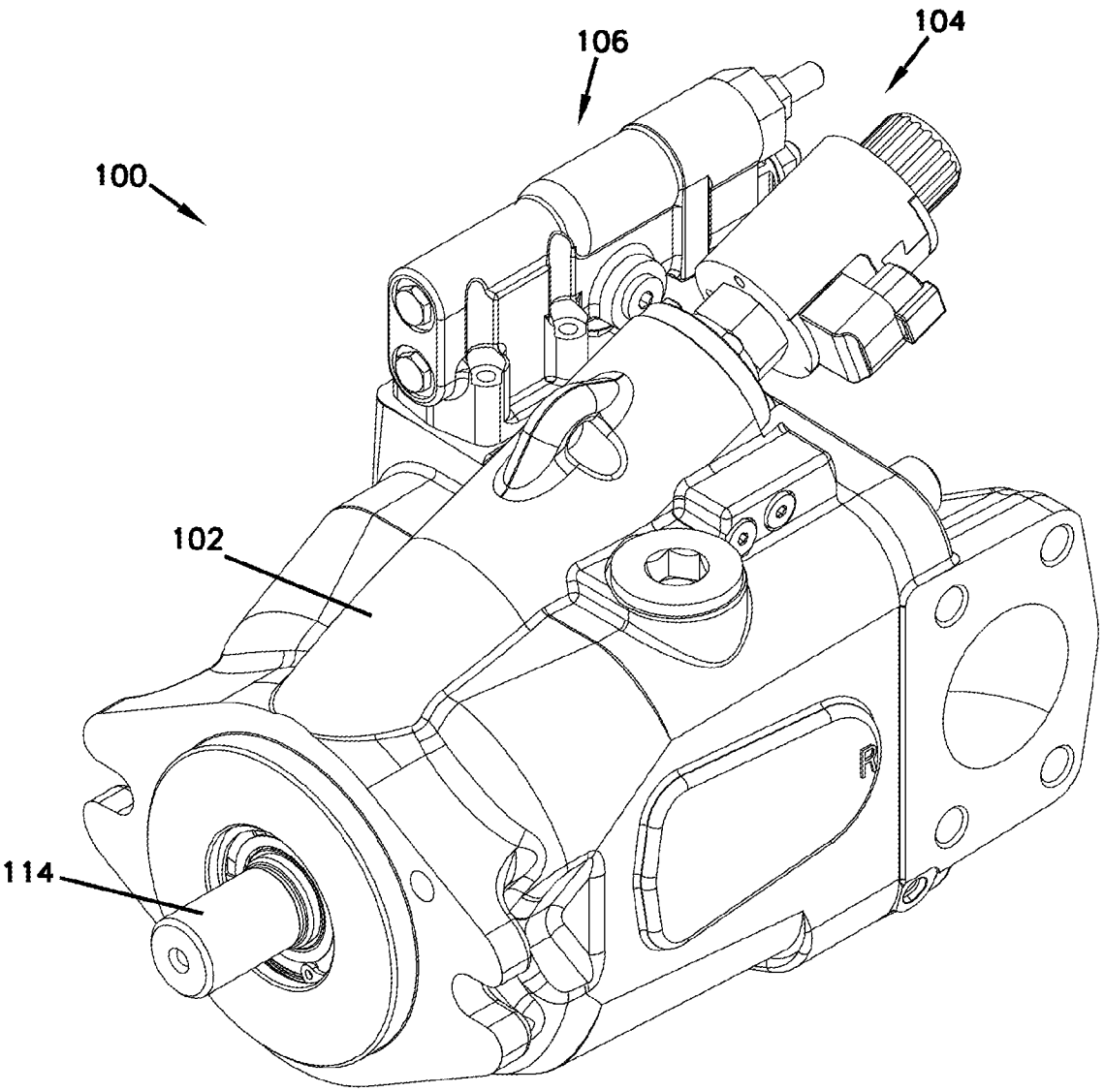
FIG. 1A is a front perspective view of a variable displacement pump system in accordance with an exemplary embodiment of the present disclosure.

Various embodiments will be described in detail with reference to the drawings, wherein like reference numerals represent like parts and assemblies throughout the several views.

In general, a variable displacement pump system in accordance with one aspect of the present disclosure employs a modular electronic displacement control system for a hydraulic variable displacement pump. The control system enables an operator to control the pump displacement by varying a command signal, such as electric current, with respect to the control system. As such, the operation of the pump is convenient and simple. In certain examples, the control system of the present disclosure reduces electric current required at the start of the variable displacement pump system, thereby reducing energy, power, and/or torque requirements. In certain examples, the control systems in the accordance with the present disclosure allow pump displacement to be efficiently directed to minimum displacement at start-up to reduce starting torque requirements for the pump. In certain examples, the control system provides a gap between a spring seat and a valve spool such that the valve spool need not overcome a biasing force from a swash plate when the swash plate changes from its maximum displacement position to its normal position (i.e., its minimum displacement position). Instead, the swash plate moves from the maximum displacement position to the neutral position using the system pressure. Further, it is possible to incorporate fail-safe options into the control system and configure the fail-safe options for both minimum and maximum displacements, which allows the pump to run full stroke as per requirement when a electrical signal is lost.

The variable displacement pump system of the present disclosure is also configured to interchangeably use different types of valve actuation systems, such as a solenoid actuator and a pilot pressure valve.

In certain examples, a variable displacement pump system in accordance with the present disclosure employs pilot pressure for controlling displacement of a hydraulic variable pump. The variable displacement pump system can reduce starting torque for engine by setting pilot pressure to a preset value to reduce a swash displacement and hence starting torque. It is also possible to incorporate fail-safe options into the control system and configure the fail-safe options for both minimum and maximum displacements, which allows the pump to run full stroke or de-stroke as per requirement when a remote pilot signal is lost. A device for providing pilot pressure to the hydraulic variable pump can be positioned remotely from the pump, and allows an operator to control the displacement of the pump by varying the pilot pressure. As such, the operation of the pump is convenient and simple. The variable displacement pump system occupies less space and can thus be used in a limited space because the pilot pressure can be supplied remotely from the pump.

Figure 2:
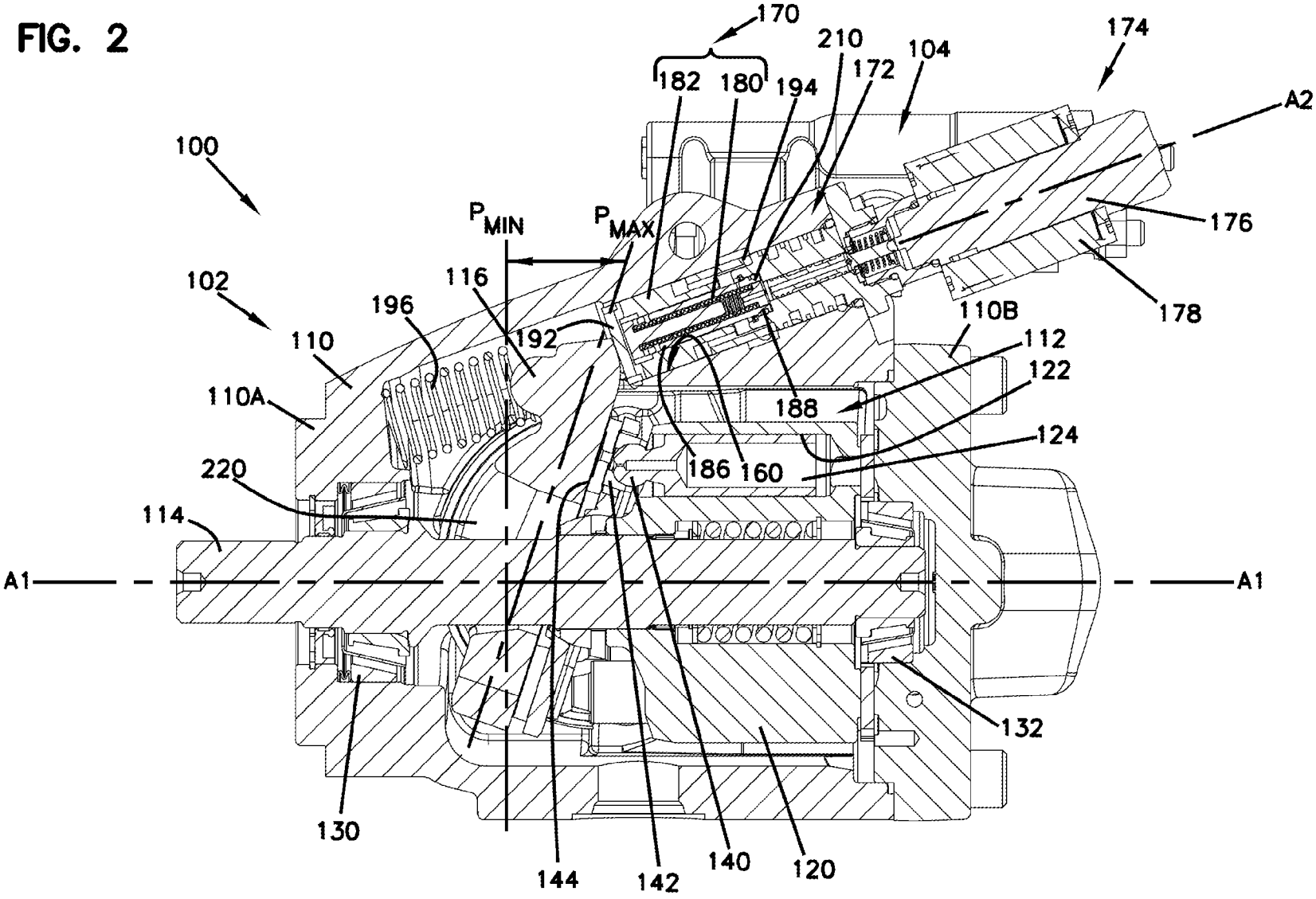
FIG. 2 is a cross-sectional view of the variable displacement pump of FIG. 1A.

Referring to FIGS. 1A, 2B, and 2, a variable displacement pump system 100 in accordance with an exemplary embodiment of the present disclosure is described. The variable displacement pump system 100 includes a variable displacement pump 102 controlled by a pump control system 104. The pump control system 104 operates to control a position of a swash plate 116 of the variable displacement pump 102, thereby controlling a displacement volume of the pump 102.

In this example, the variable displacement pump 102 is configured as an axial piston pump with a swash plate construction. As the basic structure and operation of the axial piston pump with a swash plate construction are generally known in the relevant technical area, the description of the variable displacement pump 102 is limited to the elements associated with the pump control system 104.

With reference to FIG. 2, the variable displacement pump 102 includes a pump housing 110, a rotating group 112, an input shaft 114, and a swash plate 116.

The pump housing 110 is configured to house at least some of the components of the variable displacement pump 102. In some examples, the pump housing 110 includes a base body 110A and a cover body 110B coupled with the base body 110A. The pump housing 110 defines a case volume 220 (see schematically at FIG. 3) having a case pressure $P_C$. The case volume 220 can contain hydraulic fluid for lubricating and cooling the rotating group 112. The hydraulic fluid within the case volume 220 is maintained at the case pressure $P_C$.

The rotating group 112 is mounted within the case volume 220 of the pump housing 110, and includes a rotor 120 defining a plurality of piston cylinders 122 that receive pistons 124. As described below, the rotating group 112 rotates, together with the input shaft 114, about the axis A1 relative to the swash plate 116.

The input shaft 114 is rotatably mounted within the pump housing 110 and defines an axis of rotation A1. The input shaft 114 is coupled to the rotor 120 to transfer torque from the input shaft 114 to the rotor 120, thereby allowing the input shaft 114 and the rotor 120 to rotate together about the axis of rotation A1. In some examples, a splined connection can be provided between the input shaft 114 and the rotor 120. As depicted, the input shaft 114 is mounted on a first bearing 130 and a second bearing 132 in the pump housing 110 and rotatable about the axis of rotation A1 relative to the pump housing 110.

The swash plate 116 is also positioned within the pump housing 110. The swash plate 116 is pivotally movable relative to the axis of rotation A1 between a neutral position $P_{MIN}$ and a maximum displacement position $P_{MAX}$. The neutral position can also be referred to herein as a minimum displacement position. It will be appreciated that movement of the swash plate 116 varies an angle of the swash plate 116 relative to the axis of rotation A1. Varying the angle of the swash plate 116 relative to the axis of rotation A1 varies the displacement volume of the variable displacement pump 102. The displacement volume is the amount of hydraulic fluid displaced by the variable displacement pump 102 for each rotation of the rotating group 112. When the swash plate 116 is in the neutral position, the pump displacement has a minimum value. In some examples, the minimum value can be zero displacement. When the swash plate 116 is in the maximum displacement position, the variable displacement pump 102 has a maximum displacement value.

The pistons 124 of the rotating group 112 include cylindrical heads 140 on which hydraulic shoes 142 are mounted. The hydraulic shoes 142 have end surfaces 144 that oppose the swash plate 116. Typically, hydraulic fluid provides a hydraulic bearing layer between the end surfaces 144 and the swash plate 116 that facilitates rotating the rotating group 112 about the axis of rotation A1 relative to the swash plate 116. When the swash plate 116 is in the neutral position, the swash plate 116 is generally perpendicular relative to the axis of rotation A1 thereby causing a stroke length of the pistons 124 within their respective piston cylinders 122 to be at or near zero. By adjusting the angle of the swash plate 116 relative to the axis of rotation A1, the stroke length of the pistons 124 within their corresponding piston cylinders 122 is adjusted. When the swash plate 116 is positioned at a non-perpendicular angle relative to the axis of rotation A1, the pistons 124 cycle through one stroke length in and one stroke length out relative to their corresponding rotor cylinders 122 for each rotation of the rotor 120 about the axis of rotation A1. The stroke length increases as the swash plate 116 is moved from the neutral position toward the maximum displacement position. As the pistons 124 reciprocate within their corresponding piston cylinders 122, the rotating group 112 provides a pumping action that draws hydraulic fluid into a system inlet 150 (see schematically at FIG. 3) of the variable displacement pump 102 and forces hydraulic fluid out of a system output 152 (see schematically at FIG. 3) of the variable displacement pump 102. The system output 152 has a system pressure $P_S$, which is higher than a case pressure $P_C$ (also referred to herein as a tank pressure).

With continued reference to FIG. 2, the control system 104 interacts with the swash plate 116 and controls a pump displacement position of the swash plate 116 between the neutral position and the maximum displacement position. As illustrated, the control system 104 is mounted at least partially in a cylinder or bore 160 defined by the pump housing 110. The bore 160 of the pump housing 110 has a longitudinal axis A2. In some examples, the control system 104 is directly received into, and in contact with, the bore 160 of the pump housing 110. In other examples, a sleeve can be disposed within the bore 160 and the control system 104 can be at least partially mounted within the sleeve.

The control system 104 includes a control piston assembly 170 and a control valve assembly 172. The control system 104 can further include a valve actuation system 174.

As illustrated in FIG. 2, the control piston assembly 170 includes a piston guide tube 180 and a control piston 182. The piston guide tube 180 has a first tube end 186 and an opposite second tube end 188, and is secured to the control valve assembly 172 at the second tube end 188. The piston guide tube 180 can be cylindrical and extends between the first and second tube ends 186 and 188, defining a hollow portion 210 (see schematically at FIG. 3) therewithin.

The control piston 182 is used to control the position or angle of the swash plate 116 relative to the axis of rotation A1. The control piston 182 is at least partially mounted in the bore 160 of the pump housing 110 and movable along the longitudinal axis A2. The control piston 182 has a first piston end 192 and an opposite second piston end 194 along the longitudinal axis A2. The first piston end 192 of the control piston 182 is shown engaging the swash plate 116. A swash spring 196 is provided within the pump housing 110 for biasing the swash plate 116 toward the maximum displacement position. The angle of the swash plate 116 relative to the axis of rotation A1 is adjusted by moving the control piston 182 axially (i.e., along the longitudinal axis A2) within the bore 160. The second piston end 194 of the control piston 182 is adapted to receive a displacement control force generated by a control pressure that acts on the second piston end 194 of the control piston 182. Such a displacement control force is defined in a direction opposite to the biasing force of the swash spring 196 applied to the swash plate 116 along the longitudinal axis A2. A control pressure can be applied to the second piston end 194 of the control piston 182 to cause the control piston 182 to move the swash plate 116 from the maximum displacement position toward the neutral position. The force generated by the control pressure to the second piston end 194 of the control piston 182 must exceed the spring force of the swash spring 196 (including other forces introduced to the swash plate 116, such as a force applied by a pressure within the cylinders 122 and transmitted to the swash plate 116 via the pistons 124 and the shoes 142) to move the swash plate 116 from the maximum displacement position toward the neutral position. When the force applied to the second piston end 194 of the control piston 182 is less than the spring force of the swash spring 196 (including the other forces introduced to the swash plate 116), the swash plate 116 is moved back toward the maximum displacement position.

As described below, the control piston 182 includes a piston hole 212 (see FIGS. 3 and 4) defined therewithin. The piston hole 212 can also be referred to as a piston bore. The piston hole 212 is configured to at least partially receive the piston guide tube 180 to define a case pressure chamber 214 (see FIGS. 3 and 4). In some examples, the piston hole 212 of the control piston 182 cooperates with the hollow portion 210 of the piston guide tube 180 to define a chamber (i.e., the case pressure chamber 214) that is in fluid communication with the case volume 220 of the pump housing 110.

With continued reference to FIG. 2, the control valve assembly 172 operates to control the control pressure supplied to the second piston end 194 of the control piston 182. In some examples, the control valve assembly 172 can operate to enable the second piston end 194 of the control piston 182 to be selectively in fluid communication with the case volume 220 and the system output 152.

Referring still to FIG. 2, the valve actuation system 174 operates to control the control valve assembly 172. The valve actuation system 174 can be of various types. In the illustrated example of FIGS. 2-11, the valve actuation system 174 is configured as a solenoid actuator that includes a core tube 176 and a coil 178 within a solenoid enclosure. The actuating force or excursion by the solenoid actuator can be proportional to an excitation current supplied to the solenoid actuator. In other examples, the valve actuation system 174 employs a pilot pressure as described in FIGS. 12-17.

Figure 1B:
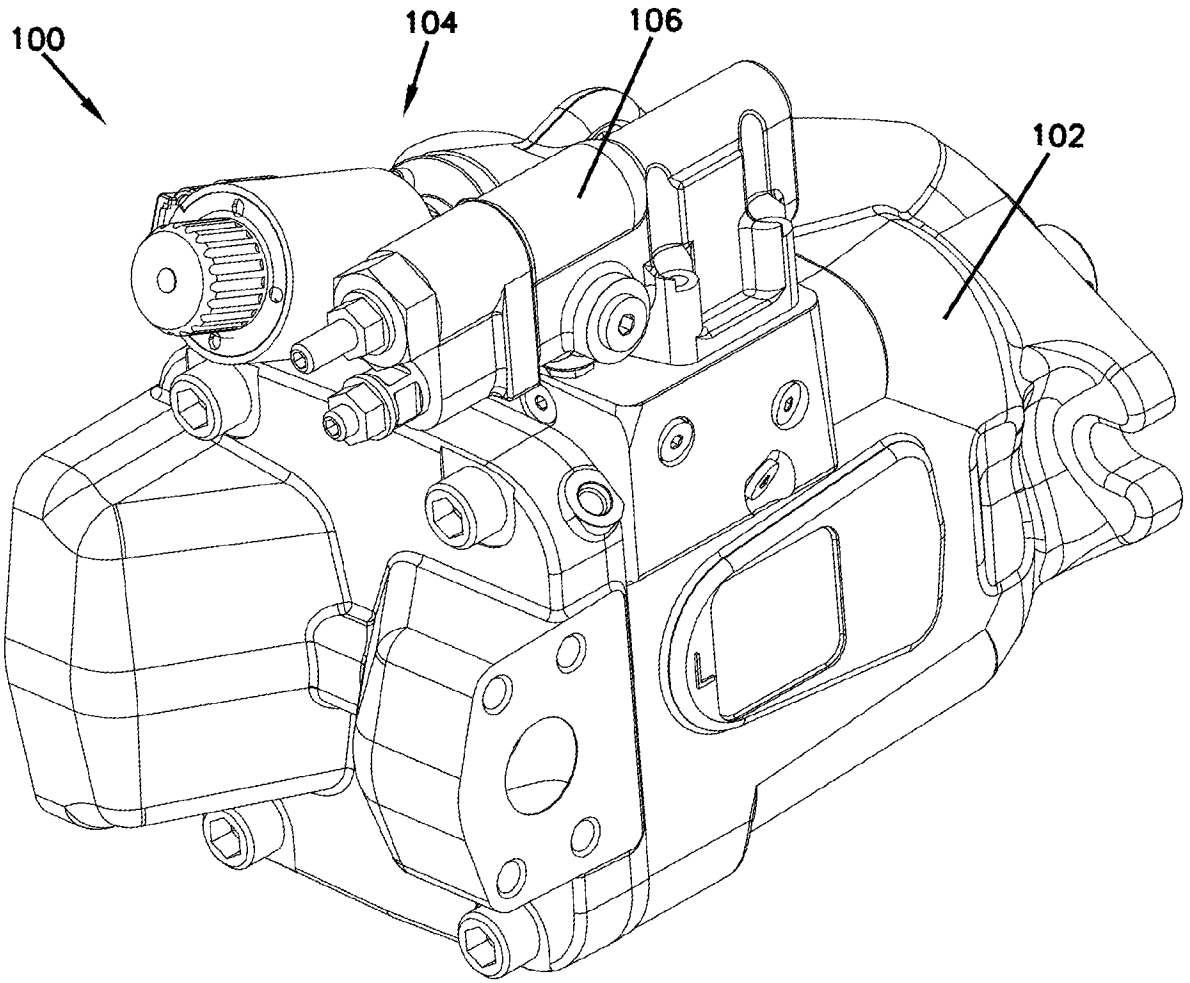
FIG. 1B is a rear perspective view of the variable displacement pump system of FIG. 1A.

In some examples, the pump control system 104 further includes a pressure compensation valve arrangement 106, as illustrated in FIGS. 1 and 2. The pressure compensation valve arrangement 106 operates to limit the pressure of the pump by de-stroking the pump at a set pressure. When the set pressure is exceeded, the pump control system 104 places the system output 152 of the pump 102 in fluid communication with the control pressure chamber 230 via an override line 153. In this way, the control pressure chamber 230 is set at the system pressure $P_S$ which drives the swash plate 116 toward the neutral position, thereby reducing the stroke distance of the pistons, which reduces the volumetric output that would otherwise exceed the desired amount. The override line 153 bypasses the control valve assembly 172 and allows the system pressure $P_S$ to be provided to the control pressure chamber 230 independently of the position of the control valve spool 282. The override line 153 can include a one-way check valve 155 that only allows hydraulic fluid to flow toward the control pressure chamber 230. The pressure compensation valve arrangement 106, as shown in FIG. 3, can have both fail-safe options for the minimum and maximum displacements, when a solenoid current is lost (where the valve actuation system 174 is a solenoid actuator) or when a pilot pressure signal is lost (where the valve actuation system 174 is a pilot pressure).

Referring to FIGS. 3-7, an exemplary embodiment of the pump control system 104 is described in more detail.

Figure 3:
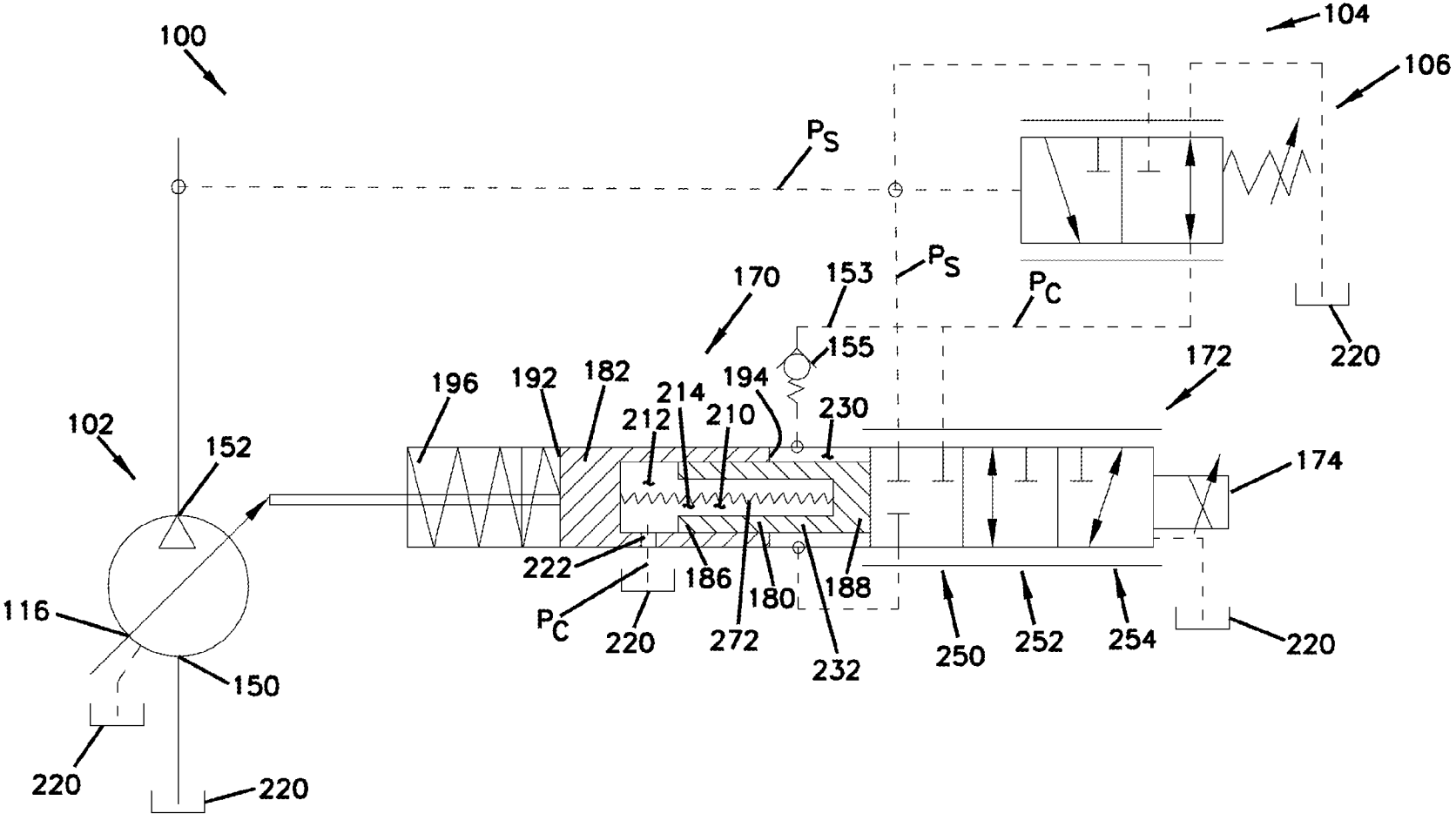
FIG. 3 is a schematic view of the variable displacement pump system of FIG. 1A.

FIG. 3 is a schematic view of the variable displacement pump system 100 including the variable displacement pump 102 and the pump control system 104. In FIG. 3, the variable displacement pump system 100 is schematically illustrated to generally show its operation. All of the specific structural features, such as the gap, seals, and other elements, are not shown in FIG. 3.

Figure 4:
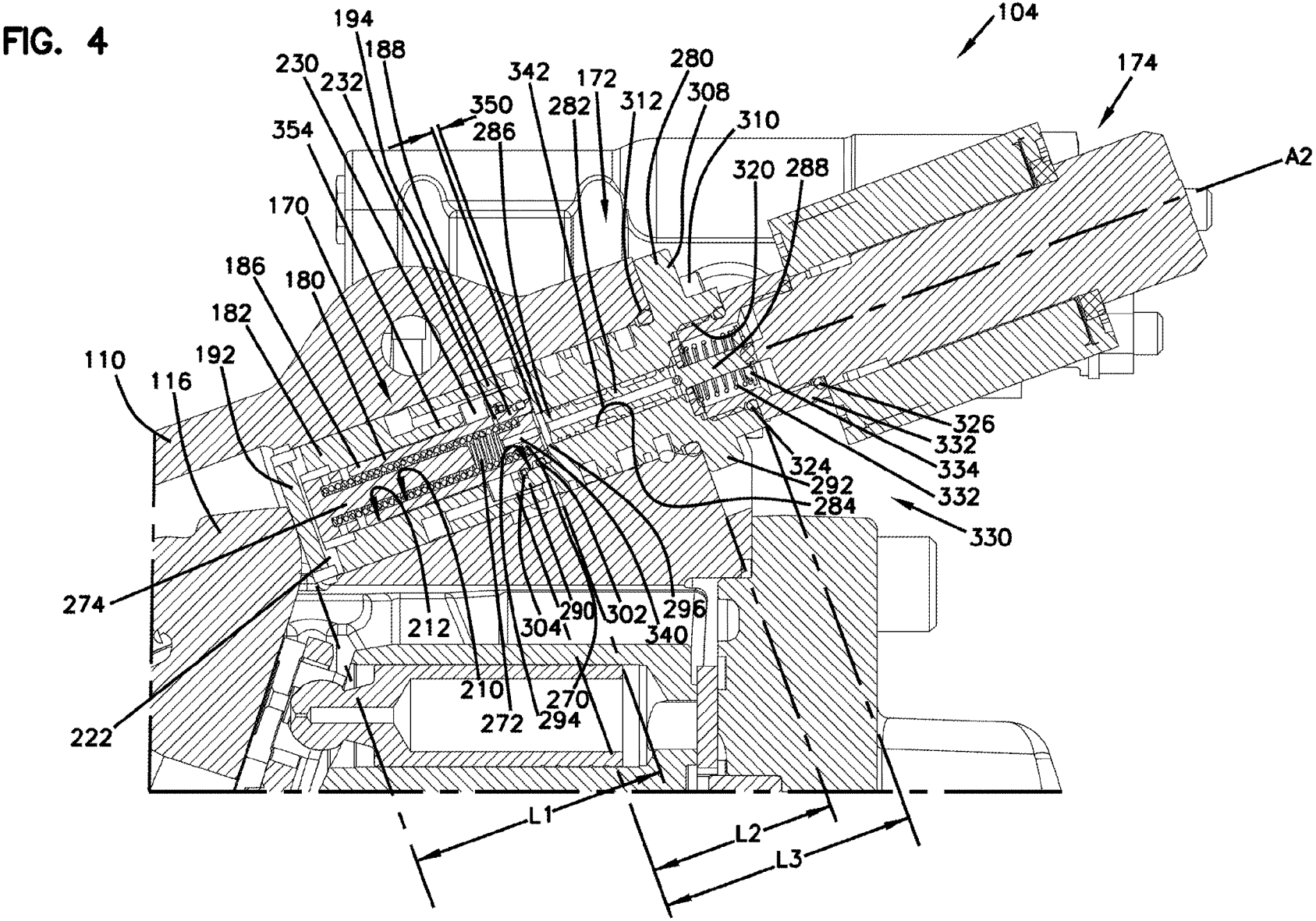
FIG. 4 is a cross-sectional view of a pump control system of the variable displacement pump system of FIG. 3 in a first condition.

As described above, the control piston assembly 170 includes the piston guide tube 180 having the hollow portion 210, and the control piston 182 having the piston hole 212. The hollow portion 210 of the piston guide tube 180 and the piston hole 212 of the control piston 182 defines the case pressure chamber 214 that is in fluid communication with the case volume 220 through a drain hole 222 provided through the control piston 182. As illustrated in FIGS. 2 and 4, the drain hole 222 can be defined at or adjacent the first piston end 192 of the control piston 182. Since the case pressure chamber 214 stays in fluid communication with the case volume 220, the case pressure chamber 214 is maintained at or near the case pressure $P_C$ throughout the operation of the variable displacement pump 102.

The control piston assembly 170 further includes a control pressure chamber 230 within which the control pressure is applied on the second piston end 194 of the control piston 182. In some examples, the control pressure chamber 230 is defined by the bore 160, the piston guide tube 180, the control piston 182 (i.e., the second piston end 194 thereof), and the control valve assembly 172. As described herein, the control pressure chamber 230 is selectively in fluid communication with the case volume 220 (or the system inlet 150) and the system output 152, depending on an operational position of the control valve assembly 172.

The piston guide tube 180 can include an orifice 232 that is defined between the control pressure chamber 230 and the case pressure chamber 214. The orifice 232 is used to slowly relieve any unintended fluid pressure that may develop in the control pressure chamber 230.

Referring still to FIG. 3, the control valve assembly 172 is movable into three different positions, such as a first valve position 250, a second valve position 252, and a third valve position 254. The control valve assembly 172 is biased to the first valve position 250. In some examples, the control valve assembly 172 is in the first valve position 250 when not actuated by the valve actuation system 174 (i.e., when the valve actuation system 174 is not in operation). The control valve assembly 172 can move from the first valve position 250 to the second valve position 252, and from the second valve position 252 to the third valve position 254. For example, where the valve actuation system 174 is a solenoid actuator, the control valve assembly 172 is in the first valve position 250 when no or little current is supplied to the valve actuation system 174. As the current supplied to the valve actuation system 174 increases, the control valve assembly 172 moves from the first valve position 250 to the second valve position 252, and then to the third valve position 254.

As such, in this example, when the valve actuation system 174 is not in operation, the control valve assembly 172 is not driven and remains in the first valve position 250. In the first valve position 250, the control pressure chamber 230 remains in fluid communication with the case volume 220, and the pressurized hydraulic fluid from the system output 152 is prohibited from being directed into the control pressure chamber 230. Therefore, the control pressure chamber 230 is maintained at the case pressure $P_C$, and the case pressure $P_C$ acts on the second piston end 194 of the control piston 182. As described herein, the case pressure $P_C$ is not sufficient to generate a displacement control force for moving the swash plate 116 from the maximum displacement position toward the neutral position.

When the control valve assembly 172 is in the second valve position 252, the control pressure chamber 230 is in fluid communication with the system output 152 and, thus, the control pressure applied on the second piston end 194 increases to the system pressure $P_S$, thereby generating a control force that is sufficient to move the swash plate 116 from the maximum displacement position to the neutral position.

When the control valve assembly 172 is in the third valve position 254, the control pressure chamber 230 is in fluid communication with the case volume 220 such that the control pressure within the control pressure chamber 230 decreases from the system pressure $P_S$. As the control pressure applied on the second piston end 194 of the control piston 182 drops, the biasing force of the swash plate 116 is permitted to move the control piston 182 back, and the swash plate 116 moves from the neutral position toward the maximum displacement position.

Figure 5:
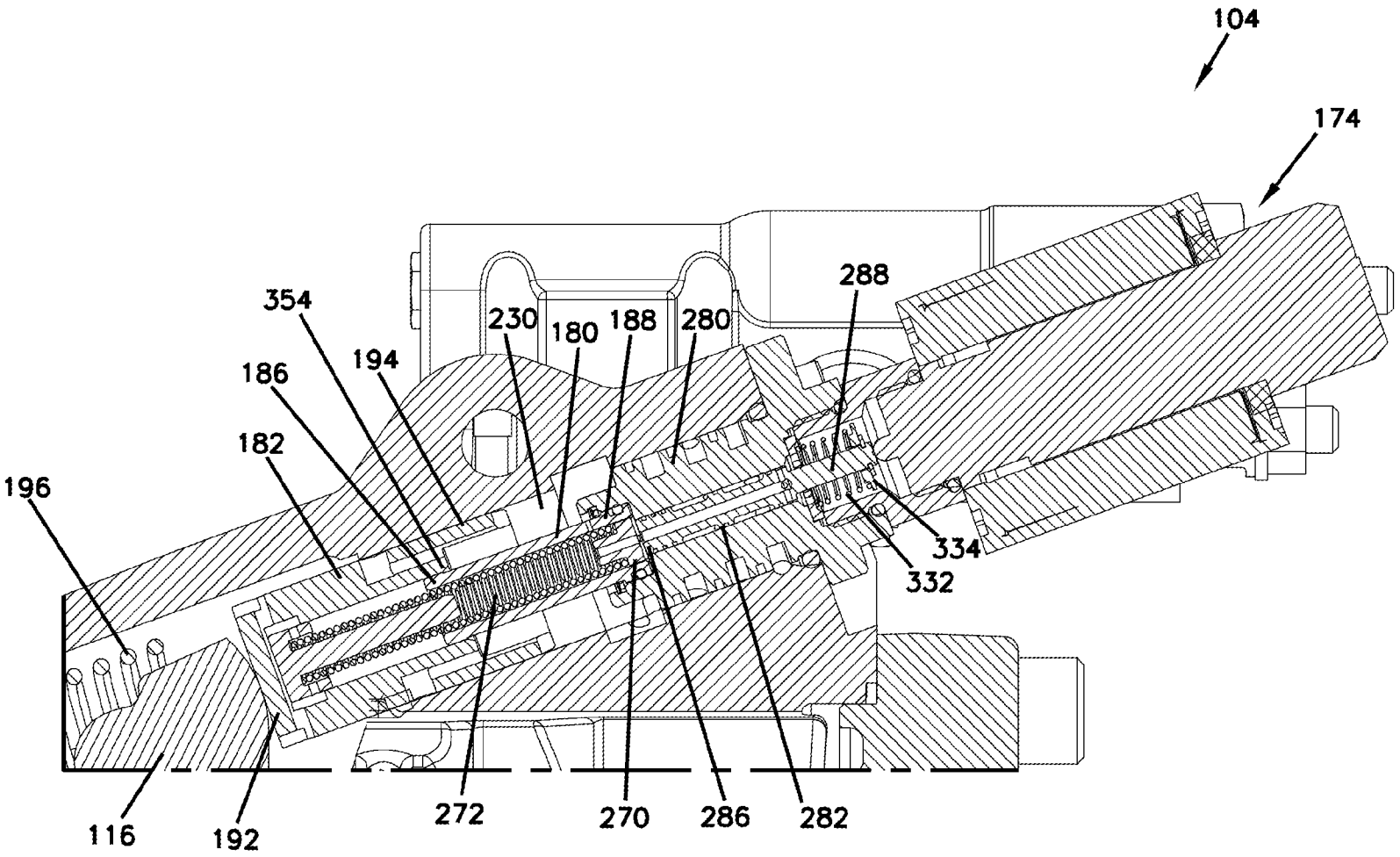
FIG. 5 is a cross-section view of the pump control system of FIG. 4 in a second condition.
Figure 6:
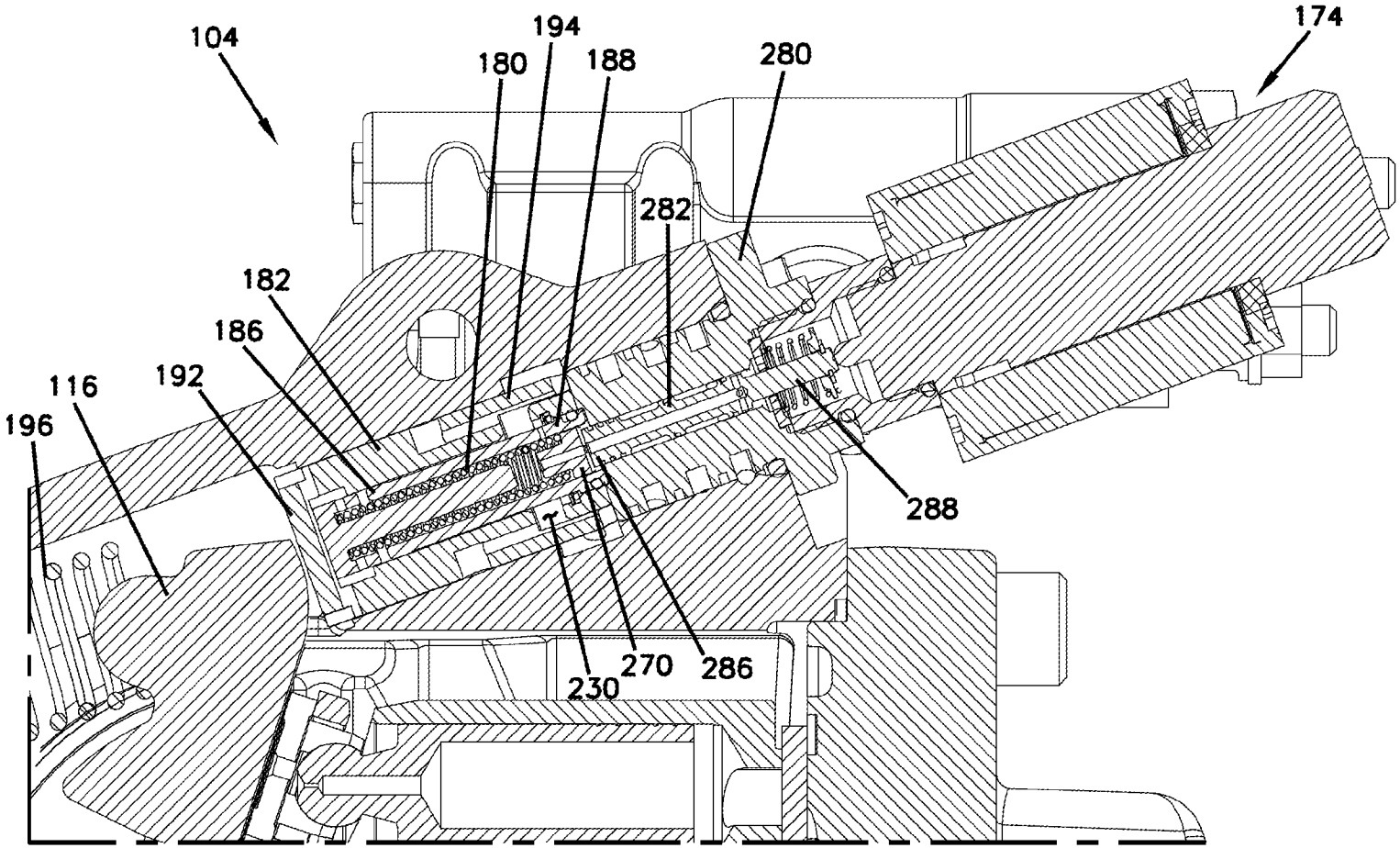
FIG. 6 is a cross-sectional view of the pump control system of FIG. 4 in a third condition.

Referring to FIGS. 4-6, an exemplary embodiment of the pump control system 104 is described. In particular, FIG. 4 is a cross-sectional view of the pump control system 104, which is in a first condition, in accordance with an exemplary embodiment of the present disclosure. FIG. 5 is a cross-section view of the pump control system 104 in a second condition, and FIG. 6 is a cross-sectional view of the pump control system 104 in a third condition.

As illustrated, the control piston assembly 170 includes a spring seat 270 disposed at the second tube end 188 of the piston guide tube 180. The spring seat 270 is movable along the longitudinal axis A2 relative to the piston guide tube 180. The control piston assembly 170 further includes a feedback spring 272 disposed between the spring seat 270 and the first piston end 192 of the control piston 182 within the control piston assembly 170. The feedback spring 272 is used to bias the spring seat 270 toward the second tube end 188 of the piston guide tube 180 (i.e., toward a valve spool 282 of the control valve assembly 172). In some examples, the control piston assembly 170 further includes a spring guide 274 extending from the first piston end 192 of the control piston 182 toward the spring seat 270 along the longitudinal axis A2. The feedback spring 272 is disposed around, and supported by, the spring guide 274.

Referring still to FIGS. 4-6, the control valve assembly 172 includes a valve housing 280 and a valve spool 282. The valve housing 280 is at least partially mounted to the bore 160 of the pump housing 110 and defines a valve bore 284 along the longitudinal axis A2. The valve housing 280 has a first housing end 290 and an opposite second housing end 292. The first housing end 290 is attached to the second tube end 188 of the piston guide tube 180. In some examples, the valve housing 280 includes a recessed portion 294 at the first housing end 290 configured to receive and secure the second tube end 188 of the piston guide tube 180. At the first housing end 290 is provided a position stop 296 configured to stop the axial movement of spring seat 270 toward the valve spool 282 along the longitudinal axis A2. In some examples, the position stop 296 can be formed as an edge at which the valve bore 284 and the recessed portion 294 meet and which has a diameter smaller than a diameter of the spring seat 270 (or the largest length passing through the center of the spring seat 270). As described herein, when the valve spool 282 does not push the spring seat 270 against the biasing force of the feedback spring 272, the spring seat 270 seats on the position stop 296 and is prevented from being brought into contact with the valve spool 282.

When the piston guide tube 180 is secured to the valve housing 280, a sealing element 302, such as an O-ring, can be disposed between the second tube end 188 of the piston guide tube 180 and the first housing end 290 of the valve housing 280. The sealing element 302 operates to isolate the control pressure chamber 230 from the case pressure chamber 214. In some examples, the second tube end 188 of the piston guide tube 180 is fastened in the recessed portion 294 of the valve housing 280 by a snap ring 304. Other methods can be used to sealingly couple the piston guide tube 180 with the valve housing 280.

As illustrated, the second housing end 292 of the valve housing 280 is configured to be secured to the pump housing 110. The valve housing 280 is secured to the pump housing 110, using a non-threaded fastening technique that does not require the valve housing 280 to be threaded in the bore 160. The valve housing 280 is simply slid into the bore 160 and fastened to the pump housing 110. In some examples, the second housing end 292 includes a mounting flange 308 configured to engage an outer rim of the bore 160 of the pump housing 110, and one or more fasteners 310 are used to fasten the mounting flange 308 to the pump housing 110 once the valve housing 280 is slid into the bore 160 of the pump housing 110. A sealing element 312, such as an O-ring, can be disposed between the pump housing 110 and the valve housing 280. As such, since the valve housing 280 is received into (e.g., slid into) the bore 160 of the pump housing 110 and fastened to the pump housing 110, the valve housing 280 occupies less space in the bore 160 than it would when the valve housing 280 is threaded into the bore 160. For example, for a threaded coupling, the valve housing 280 needs an outer threaded portion therearound, and the bore 160 of the pump housing 110 needs a corresponding inner threaded portion. Therefore, the valve housing 280 should have a longer length to include the outer threaded portion as well as typical valve components (e.g., channels, holes, and grooves). By removing a threaded portion, the valve housing 280 of the present disclosure uses a smaller portion of the bore 160 along the longitudinal axis A2, thereby allowing a longer length of the control piston assembly 170, provided that the axial length of the bore 160 remains constant. A longer control piston assembly 170 has several advantages. For example, the control piston assembly 170 can provide a longer stroke length of the control piston 182, which allows a large variation between the minimum and maximum displacement positions of the swash plate 116. In some examples, the control piston assembly 170 and the control valve assembly 172 are configured such that an axial length L1 of the control piston assembly 170 is longer than an axial length L2 of a portion of the control valve assembly 172 that is received in the bore 160. In other examples, the control piston assembly 170 and the control valve assembly 172 are configured such that the axial length L1 of the control piston assembly 170 is longer than an axial length L3 of the control valve assembly 172.

With continued reference to FIGS. 4-6, the valve spool 282 is received within the valve bore 284. The valve spool 282 is driven by the valve actuation system 174 to move along the longitudinal axis A2 relative to the valve housing 280. Depending on the position within the valve housing 280, the valve spool 282 can control a magnitude of a control pressure within the control pressure chamber 230, as described below. The valve spool 282 includes a forward end 286 and an opposite rearward end 288. The forward end 286 of the valve spool 282 is adapted to contact and move the spring seat 270 against a biasing force of the feedback spring 272 along the longitudinal axis A2. The rearward end 288 of the valve spool 282 is configured to be driven by the valve actuation system 174.

As illustrated, the second housing end 292 of the valve housing 280 is configured to mount the valve actuation system 174. In some examples, the valve housing 280 includes an actuation cavity 320 defined at the second housing end 292. The actuation cavity 320 is adapted to couple the valve actuation system 174 therein. In some examples, a mounting adapter 322 (or nut or fitting) is provided and at least partially engaged with the actuation cavity 320 of the valve housing 280 to connect the valve actuation system 174 to the valve housing 280. Sealing members 324 and 326 can be disposed between the valve housing 280 and the mounting adapter 322 and between the mounting adapter 322 and the valve actuation system 174.

The rearward end 288 of the valve spool 282 can extend to the actuation cavity 320 to engage the output of the valve actuation system 174 within the actuation cavity 320. The control valve assembly 172 further includes a spool biasing member 330 configured to bias the valve spool 282 toward the second housing end 292 of the valve housing 280. In some examples, the spool biasing member 330 includes a spring 332 and a spring seat plate 334. The spring seat plate 334 is fixed to the rearward end 288 of the valve spool 282 that is exposed to the actuation cavity 320, and the spring 332 is disposed between a bottom surface of the actuation cavity 320 and the spring seat plate 334 along the longitudinal axis A2. The spring 332 is compressed between the bottom surface of the actuation cavity 320 and the spring seat plate 334 coupled to the valve spool 282, thereby biasing the valve spool 282 toward the second housing end 292 of the valve housing 280 (i.e., toward the valve actuation system 174).

With continued reference to FIGS. 4-6, the spring seat 270 can include a fluid channel 340 defined therethrough to provide fluid communication between the case pressure chamber 214 and the forward end 286 of the valve spool 282 of the control valve assembly 172. In some examples, the valve spool 282 includes a fluid channel 342 defined therewithin along the longitudinal axis A2. The fluid channel 342 of the valve spool 282 is configured to provide fluid communication between the forward end 286 of the valve spool 282 and the actuation cavity 320. Therefore, the fluid channel 340 of the spring seat 270 and the fluid channel 342 of the valve spool 282 permits a fluid communication between the case pressure chamber 214 of the control piston assembly 170 and the actuation cavity 320 of the control valve assembly 172. This configuration enables the opposite axial ends (i.e., the forward and rearward ends 286 and 288) of the valve spool 282 to be at the same pressure, i.e., the case pressure $P_C$. This also maintains the axially opposite ends of the piston guide tube 180 at the same pressure, thereby maintaining the majority of the system at a low pressure. This configuration makes it easy to provide sealing in the system.

As illustrated, the piston guide tube 180 and the control piston 182 are engaged at an interface 354 (FIGS. 4 and 5) such that sealing is provided between the control pressure chamber 230 and the case pressure chamber 214. The engagement between the piston guide tube 180 and the control piston 182 remains at the interface 354 during the stroke of the control piston 182. The axial length of the interface 354 is reduced when the control piston 182 is moved away from the control valve assembly 172. However, the reduced interface 354 is configured to still provide appropriate sealing between the case pressure chamber 214 and the control pressure chamber 230.

Referring again to FIGS. 4-6, a method of adjusting the swash plate 116 is described using the pump control system 104 in accordance with an exemplary embodiment of the present disclosure. In this example, the valve actuation system 174 is a solenoid actuator that generates an actuating force that is proportional to excitation current. For clarity, the valve actuation system 174 is interchangeably referred to as the solenoid actuator with respect to FIGS. 4-6.

FIG. 4 illustrates that the valve spool 282 is in a first operating stage (also referred to herein as an initial position, a first position, or a zero current position) when the solenoid actuator 174 is not in operation (i.e., not excited). The valve spool 282 is biased to this position by the spool biasing member 330. The first operating stage of the valve spool 282 corresponds to a stage starting from the first valve position 250 prior to the second valve position 252, as described in FIG. 3. As such, the control pressure chamber 230 is in fluid communication with the case volume 220 via the orifice 232, and is not in fluid communication with the pump outlet 152 (i.e., the system pressure $P_S$), and the swash plate 166 is thus in the maximum displacement position (i.e., stroked position).

As illustrated in FIG. 4, the pump control system 104 is configured such that a gap 350 is defined between the forward end 286 of the valve spool 282 and the spring seat 270 when the valve spool 282 is in the first operating stage (i.e., the first valve position 250). During the first operating stage, the spring seat 270 butts against the position stop 296 of the valve housing 280, and the gap 350 prohibits the spring seat 270 to engage the valve spool 282. Therefore, the feedback spring 272 exerts no force on the valve spool 282. The control pressure chamber 230 is blocked from the system output 152. Since the control pressure chamber 230 is in fluid communication with the case pressure chamber 214 through the orifice 232, the control pressure chamber 230 is maintained at the same pressure, or at a pressure close to, a pressure (i.e., the case pressure $P_C$) of the case pressure chamber 214. The case pressure $P_C$ does not generate a force acting on the second piston end 194 that exceeds the biasing force from the swash plate 116. Therefore, the swash plate 116 remains the maximum displacement position.

In some examples, the valve spool 282 remains in the first operating stage until a certain amount of electric current is supplied to the solenoid actuator 174. As the electric current supplied to the solenoid actuator 174 gradually increases, the valve spool 282 moves toward the spring seat 270, reducing the gap 350. FIG. 5 illustrates that the valve spool 282 has moved until the forward end 286 of the valve spool 282 contacts the spring seat 270, removing the gap 350. In FIG. 5, the valve spool 282 is in the second operating stage. When the valve spool 282 is in the second operating stage (FIG. 5), the control pressure chamber 230 becomes in fluid communication with the system output 152, allowing the pressurized hydraulic fluid to flow into the control pressure chamber 230. Therefore, the control pressure acting on the second piston end 194 of the control piston 182 increases, which can generates a force that exceeds the biasing force of the swash plate 116. In some examples, the control pressure can increase up to the system pressure $P_S$. As a result, the swash plate 116 moves to the neutral position, as illustrated in FIG. 5, thereby de-stroking the pump 102 to its minimum displacement. In some examples, the gap 350 is configured such that, when the valve spool 282 touches the spring seat 270, the control pressure chamber 230 is open to the system output 152 and is blocked from the case volume 220 (since the orifice 232 is too small to have effect in this case), which corresponds to the second valve position 252 as described in FIG. 3. In some examples, the gap 350 is adjustable.

As the excitation current further increases after the second operating stage (i.e., after the valve spool 282 contacts the spring seat 270), the valve spool 282 further moves toward (or into) the control piston assembly 170, pushing the spring seat 270 further into the piston guide tube 180. As the position of the valve spool 282 changes, the control pressure chamber 230 becomes in fluid communication with the case volume 220, thereby reducing the control pressure within the control pressure chamber 230. This corresponds to the third operating stage as illustrated in FIG. 6. As the control pressure acting on the second piston end 194 of the control piston 182 changes to a pressure that generates a force less than the biasing force of the swash plate 116, the swash plate 116 strokes and moves toward the maximum displacement position. As the swash plate 116 moves toward the maximum displacement position, the control piston 182 engaged with the swash plate 116 compresses the feedback spring 272, acting against the solenoid force generated by the solenoid actuator 174 (which acts on the valve spool 282). Once a force F1 exerting on the spring seat 270 is balanced with an opposite force F2 from the valve spool 282, the swash plate 116 is maintained at a particular angle, generating a particular amount of hydraulic fluid displacement. FIG. 6 illustrates that the control system 104 is at this equilibrium condition, which is also referred to herein as the third operating stage. In the third operating stage, the angle of the swash plate 116 can vary proportionally to the amount of current applied to the solenoid actuator 174. In particular, as the current increases to the solenoid actuator 174, the angle of the swash plate 116 increases, moving toward the maximum displacement position. As such, the displacement of the pump 102 can be linearly adjusted by controlling the solenoid actuator 174. Therefore, the equilibrium condition can be referred to herein as a pump operation condition.

Figure 7B:
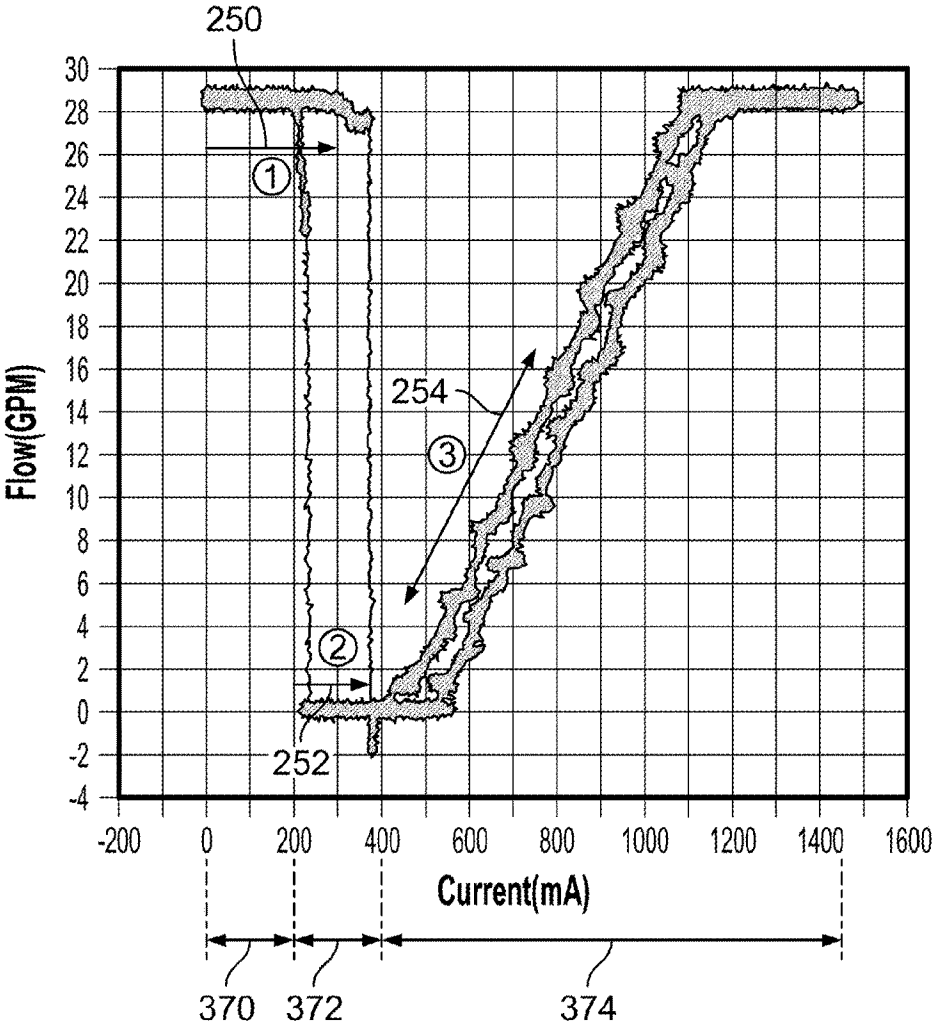
FIG. 7B is a graph of hydraulic fluid flow rate versus solenoid current, illustrating an example operation of the pump control system of FIGS. 4-6.

Referring to FIG. 7B, a graph is illustrated of hydraulic fluid flow rate over solenoid current to represent the operation of the control system of FIGS. 4-6. The graph shows three operating stages as described above.

As illustrated, the pump 102 is in the maximum displacement condition when no current is supplied to the solenoid actuator 174. This is illustrated as a first segment 370 in FIG. 7B, which corresponds to the first operating stage as shown in FIG. 4. The operation of the control system 104 at the maximum displacement condition is illustrated in FIG. 4. The maximum displacement of the pump 102 is maintained until the current increases to a first current (e.g., about 200-300 mA in this example). Once the first current is reached, the pump 102 changes to the minimum displacement condition, which is illustrated as a second segment 372 in FIG. 7B, which corresponds to the second operating stage as illustrated in FIG. 5. The minimum displacement of the pump 102 is maintained until the current reaches a second current (e.g., about 400 mA in this example). When the current supplied to the solenoid actuator 174 is more than the second current, the pump 102 moves into the equilibrium condition, which is illustrated in a third segment 374 in FIG. 7B, which corresponds to the third operating stage as illustrated in FIG. 6. At the equilibrium condition, the displacement of the pump 102 is controlled proportionally to the amount of current supplied to the solenoid actuator 174. The hydraulic fluid flow increases as the solenoid current increases, or vice versa, during the equilibrium condition.

Figure 7A:
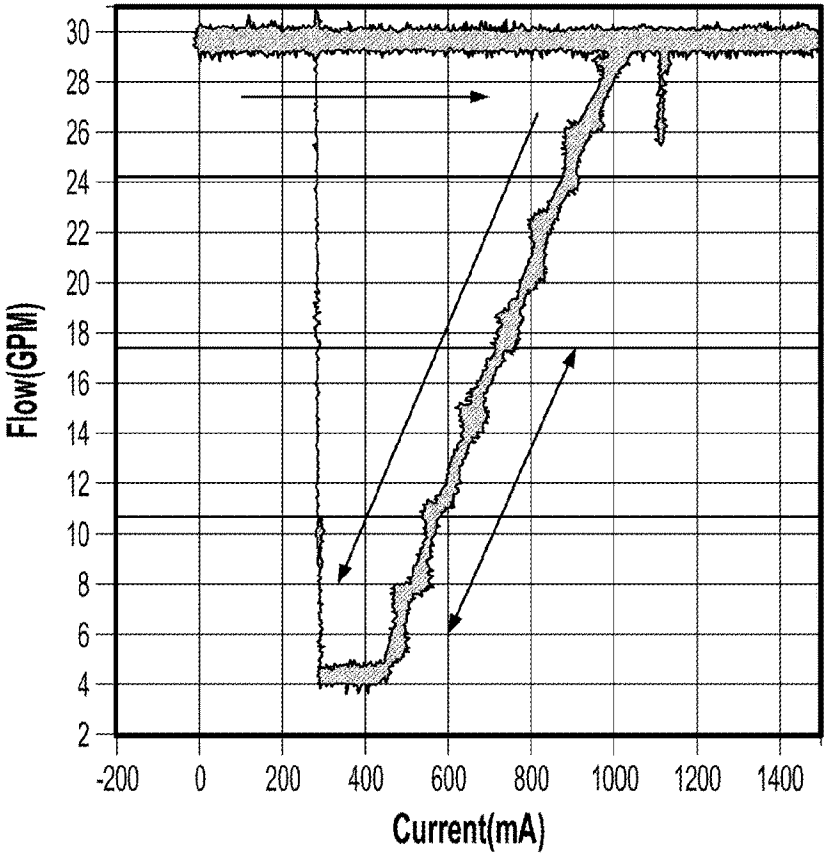
FIG. 7A is a graph of hydraulic fluid flow rate versus solenoid current, illustrating an operation of a prior art pump control system.

The control system 104 as described in FIGS. 4-6 has several advantages over prior art control systems, such as those available from Bosch Rexroth AG (Lohr am Main, Germany). The characteristics of such prior art control systems are illustrated in FIG. 7A. As illustrated, to reach the equilibrium condition or pump operation condition, a larger amount of current needs to be supplied to the solenoid actuator 174 than the control system 104 of the present disclosure. The prior art control systems require a larger amount of solenoid current because a valve spool initially needs to overcome a biasing force from a swash plate to change the swash plate from the maximum displacement position to the neutral position. The prior art control systems need a large amount of solenoid current at the beginning of the system operation and then reduce the current to decrease fluid displacement. In contrast, the control system 104 of the present disclosure provides the gap 350 between the spring seat 270 and the valve spool 282 such that the valve spool 282 need not overcome the biasing force from the swash plate 116 when the swash plate 116 changes from the maximum displacement position to the neutral position. Instead, the swash plate 116 moves from the maximum displacement position to the neutral position using the system pressure $P_S$ that is drawn to the control pressure chamber 230. Therefore, the control system 104 of the present disclosure need not provide a large amount of solenoid current at the beginning of the system operation and then reduce the current to decrease fluid displacement. It is also possible to reduce starting torque for the system.

The control system 104 including the spring seat 270, the position stop 296, and the valve spool 282 is configured to precisely define the gap 350 to determine a distance between the first and second valve positions 250 and 252. As described above, the gap 350 allows the system pressure $P_S$, not the valve actuation system 174, to move the swash plate 116 from the maximum displacement position to the neutral position Referring to FIGS. 8-11, another exemplary embodiment of the pump control system 104 is described. The pump control system 104 in this example is similarly configured as the pump control system 104 in the example of FIGS. 3-7. Therefore, the description for the first example is hereby incorporated by reference for this example. Where like or similar features or elements are shown, the same reference numbers will be used where possible. The following description for this example will be limited primarily to the differences from the first example.

Figure 8:
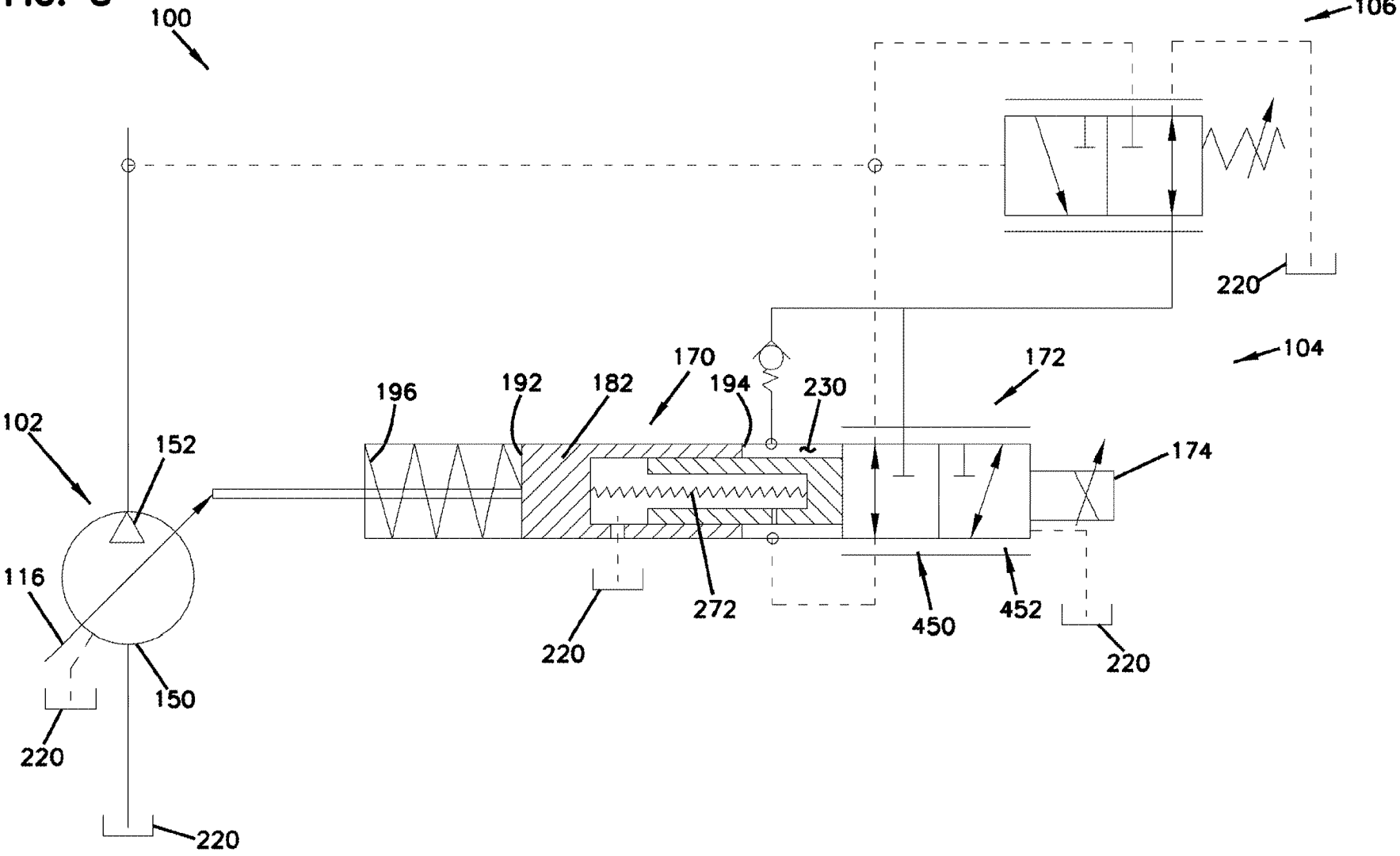
FIG. 8 is a schematic view of a variable displacement pump system in accordance with another exemplary embodiment of the present disclosure.

FIG. 8 is a schematic view of the variable displacement pump system 100 according to the second example of the present disclosure. As illustrated, the control valve assembly 172 of this example is movable into two different positions, such as a first valve position 450 and a second valve position 452. The control valve assembly 172 is biased to the first valve position 450. In some examples, the control valve assembly 172 is in the first valve position 450 when not actuated by the valve actuation system 174 (i.e., when the valve actuation system 174 is not in operation). The control valve assembly 172 can move from the first valve position 450 to the second valve position 452. For example, where the valve actuation system 174 is a solenoid actuator, the control valve assembly 172 is in the first valve position 450 when no or little current is supplied to the valve actuation system 174. As the current supplied to the valve actuation system 174 increases, the control valve assembly 172 moves from the first valve position 450 to the second valve position 452.

As such, in this example, when the valve actuation system 174 is not in operation, the control valve assembly 172 is not driven and remains in the first valve position 450. In the first valve position 450, the control pressure chamber 230 is in fluid communication with the system output 152 so that the pressurized hydraulic fluid is drawn from the system output 152 to the control pressure chamber 230. In this position, the control pressure chamber 230 is not in communication with the case volume 220.

Therefore, the control pressure applied on the second piston end 194 of the control piston 182 can be the system pressure $P_S$, which generates a control force that is sufficient to maintain the swash plate 116 at its neutral position.

When the control valve assembly 172 is in the second valve position 452, the control pressure chamber 230 is in fluid communication with the case volume 220, but not with the system output 152. Therefore, the control pressure within the control pressure chamber 230 decreases from the system pressure $P_S$. As the control pressure applied on the second piston end 194 of the control piston 182 drops, the biasing force of the swash plate 116 is permitted to move the control piston 182 back, and the swash plate 116 moves from the neutral position toward the maximum displacement position.

Figure 9:
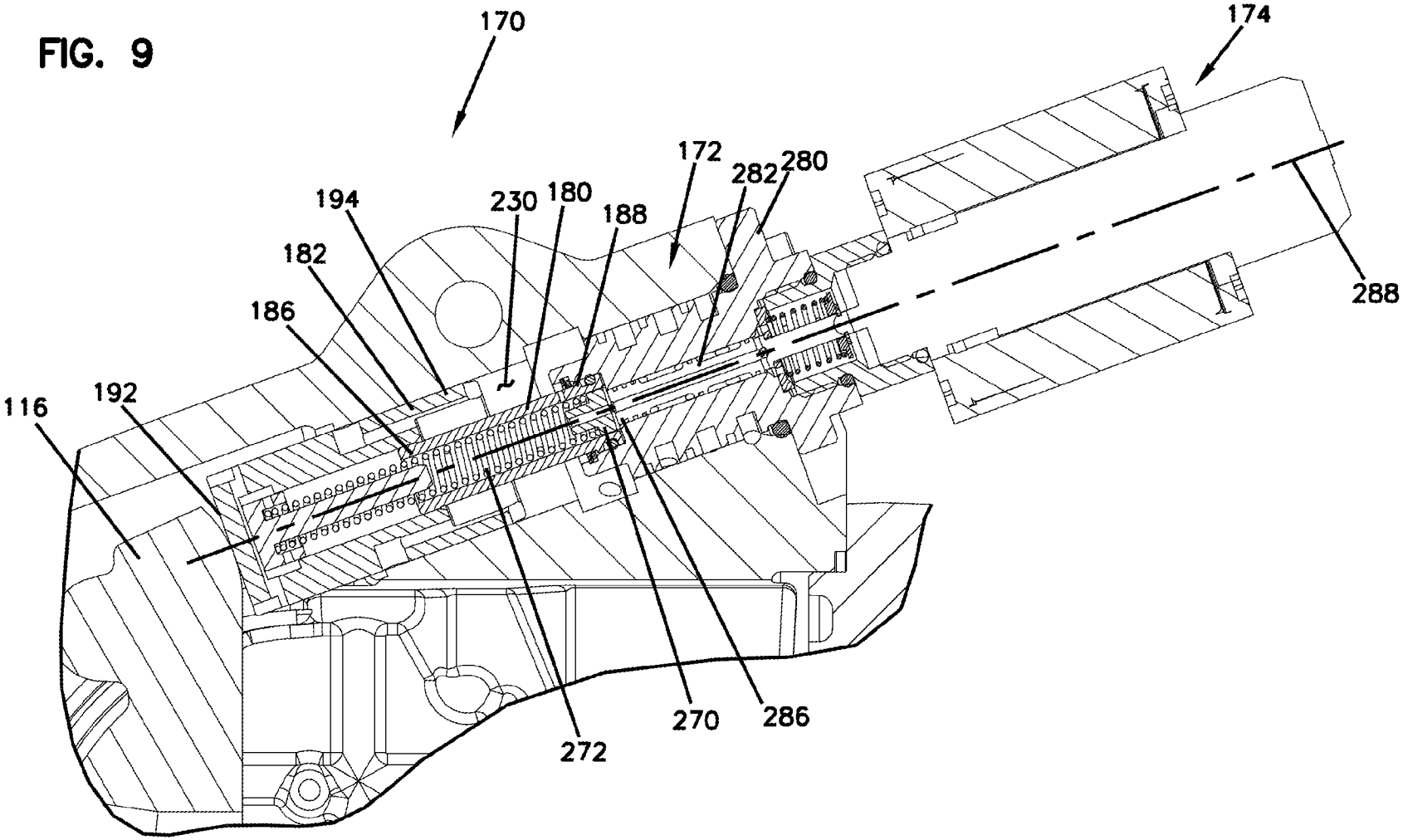
FIG. 9 is a cross-sectional view of a pump control system of the variable displacement pump system of FIG. 8 in a first condition.
Figure 10:
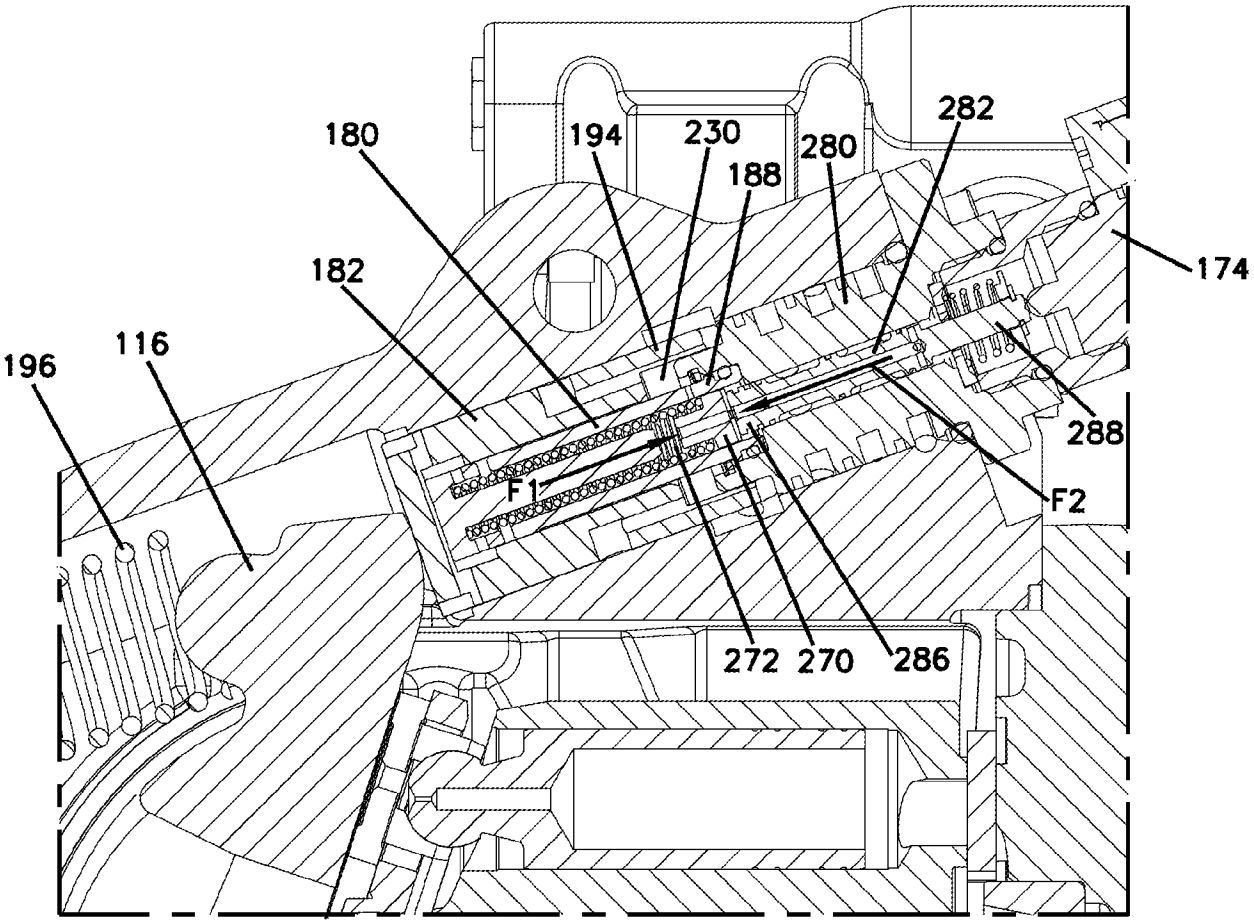
FIG. 10 is a cross-section view of the pump control system of FIG. 9 in a second condition.

Referring to FIGS. 9 and 10, a method of adjusting the swash plate 116 is described using the pump control system 104 in accordance with the second example of the present disclosure. In particular, FIG. 9 is a cross-sectional view of the pump control system 104, which is in a first condition, in accordance with an exemplary embodiment of the present disclosure. FIG. 10 is a cross-section view of the pump control system 104 in a second condition. Similarly to the first example, the valve actuation system 174 of this example is a solenoid actuator that generates an actuating force that is proportional to excitation current. For clarity, the valve actuation system 174 is interchangeably referred to as the solenoid actuator with respect to FIGS. 9 and 10.

FIG. 9 illustrates that the valve spool 282 is in a first operating stage (also referred to herein as an initial position or a zero current position) when the solenoid actuator 174 is not in operation (i.e., not excited). The valve spool 282 is biased to this position by the spool biasing member 330. The first operating stage of the valve spool 282 corresponds to the first valve position 450 as described in FIG. 8. As such, the control pressure chamber 230 is in fluid communication with the system output 152, and the swash plate 166 is in the minimum displacement position (i.e., de-stroked position).

Unlike the pump control system 104 of FIGS. 3-7, the pump control system 104 has no gap (or very little gap) between the forward end 286 of the valve spool 282 and the spring seat 270 when the valve spool 282 is in the first operating stage (i.e., the first valve position 450). At the first operating stage, the spring seat 270 butts against the position stop 296 of the valve housing 280, and the valve spool 282 does not push the spring seat 270 against the biasing force of the feedback spring 272. Therefore, the feedback spring 272 exerts no force on the valve spool 282. The control pressure chamber 230 is open to the system output 152. Since the control pressure chamber 230 is in fluid communication with the system output 152, the control pressure chamber 230 is maintained at the same pressure, or at a pressure close to, the system pressure $P_S$. The system pressure $P_S$ generates a force acting on the second piston end 194 that exceeds the biasing force from the swash plate 116. Therefore, the swash plate 116 remains the minimum displacement position.

As the excitation current increases, the valve spool 282 moves toward (or into) the control piston assembly 170, pushing the spring seat 270 into the piston guide tube 180. As the position of the valve spool 282 changes, the control pressure chamber 230 becomes in fluid communication with the case volume 220, thereby reducing the control pressure within the control pressure chamber 230. This corresponds to the second valve position 452 as described in FIG. 8. As the control pressure acting on the second piston end 194 of the control piston 182 changes to a pressure that generates a force less than the biasing force of the swash plate 116, the swash plate 116 strokes and moves toward the maximum displacement position. As the swash plate 116 moves toward the maximum displacement position, the control piston 182 engaged with the swash plate 116 compresses the feedback spring 272, acting against the solenoid force generated by the solenoid actuator 174 (which acts on the valve spool 282). Once a force F1 exerting on the spring seat 270 is balanced with an opposite force F2 from the valve spool 282, the swash plate 116 is maintained at a particular angle, generating a particular amount of hydraulic fluid displacement. FIG. 10 illustrates that the control system 104 is at this equilibrium condition, which is also referred to herein as the second operating stage. In the second operating stage, the angle of the swash plate 116 is proportional to the amount of current applied to the solenoid actuator 174. In particular, as the current increases to the solenoid actuator 174, the angle of the swash plate 116 increases, moving toward the maximum displacement position. As such, the displacement of the pump 102 can be linearly adjusted by controlling the solenoid actuator 174. Therefore, the equilibrium condition can be referred to herein as a pump operation condition.

Figure 11:
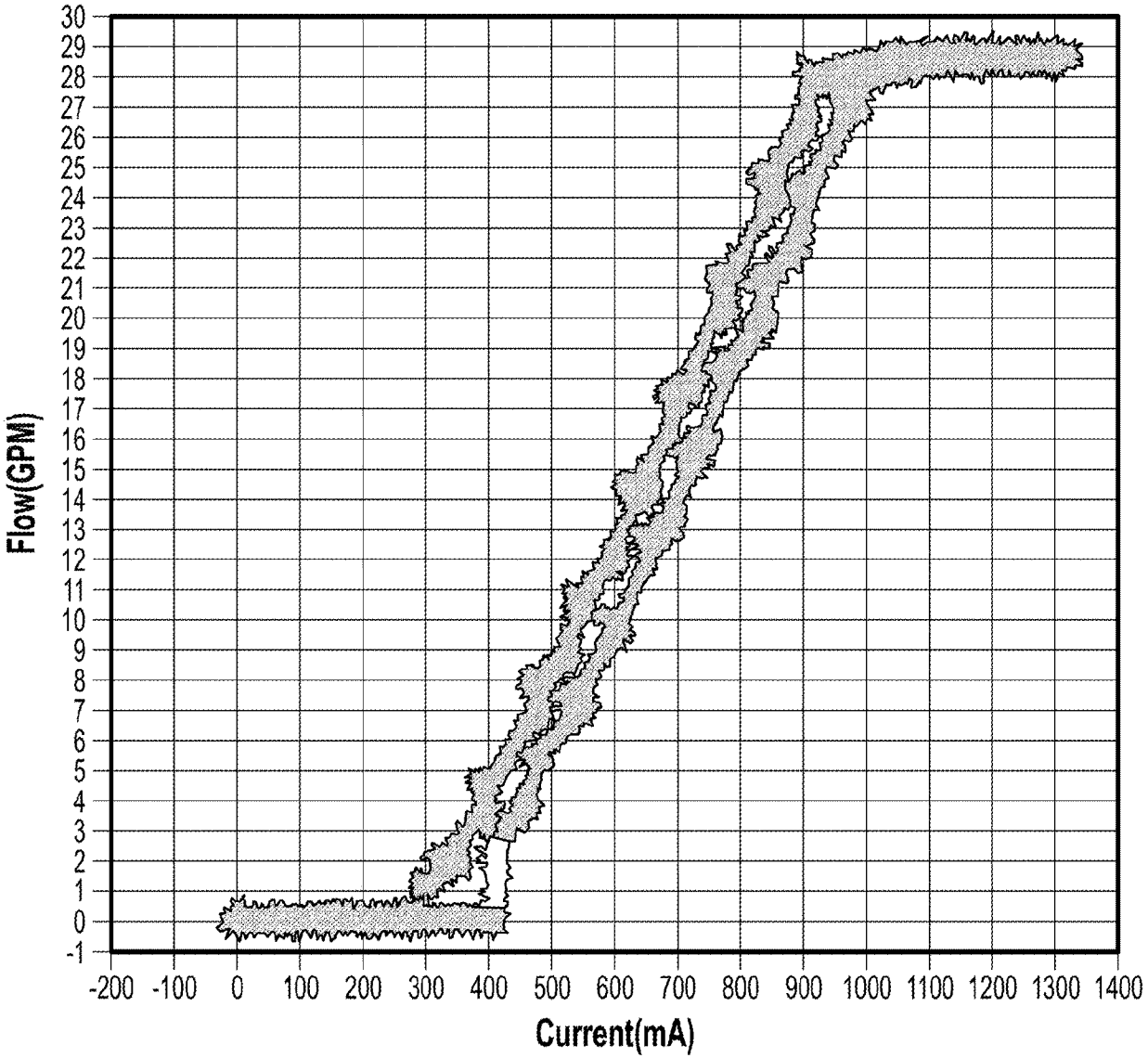
FIG. 11 is a graph of hydraulic fluid flow rate versus solenoid current supplied to the pump control system of FIGS. 9 and 10.

FIG. 11 is a graph of hydraulic fluid flow rate versus solenoid current supplied to the pump control system 104 of FIGS. 9 and 10.

Referring to FIGS. 12-17, it is described that the pump control system 104 is configured to be operated with different valve actuation systems 174. In the illustrated example of FIGS. 12-17, the pump control system 104 can be connected to, and controlled by, a pressure of a pilot fluid supplied from a remote device. For example, the valve actuation system 174 can include a proportional pressure reducing valve or proportional pressure control valve, such as Vickers® available from Eaton Corporation (Cleveland, Ohio). Such a proportion pressure reducing valve can include an electro-hydraulic proportional pressure pilot stage by which the reduced pressure setting is adjustable in response to an electrical input. The outlet pressure can be controlled by the solenoid operated proportional pilot valve.

Figure 12A:
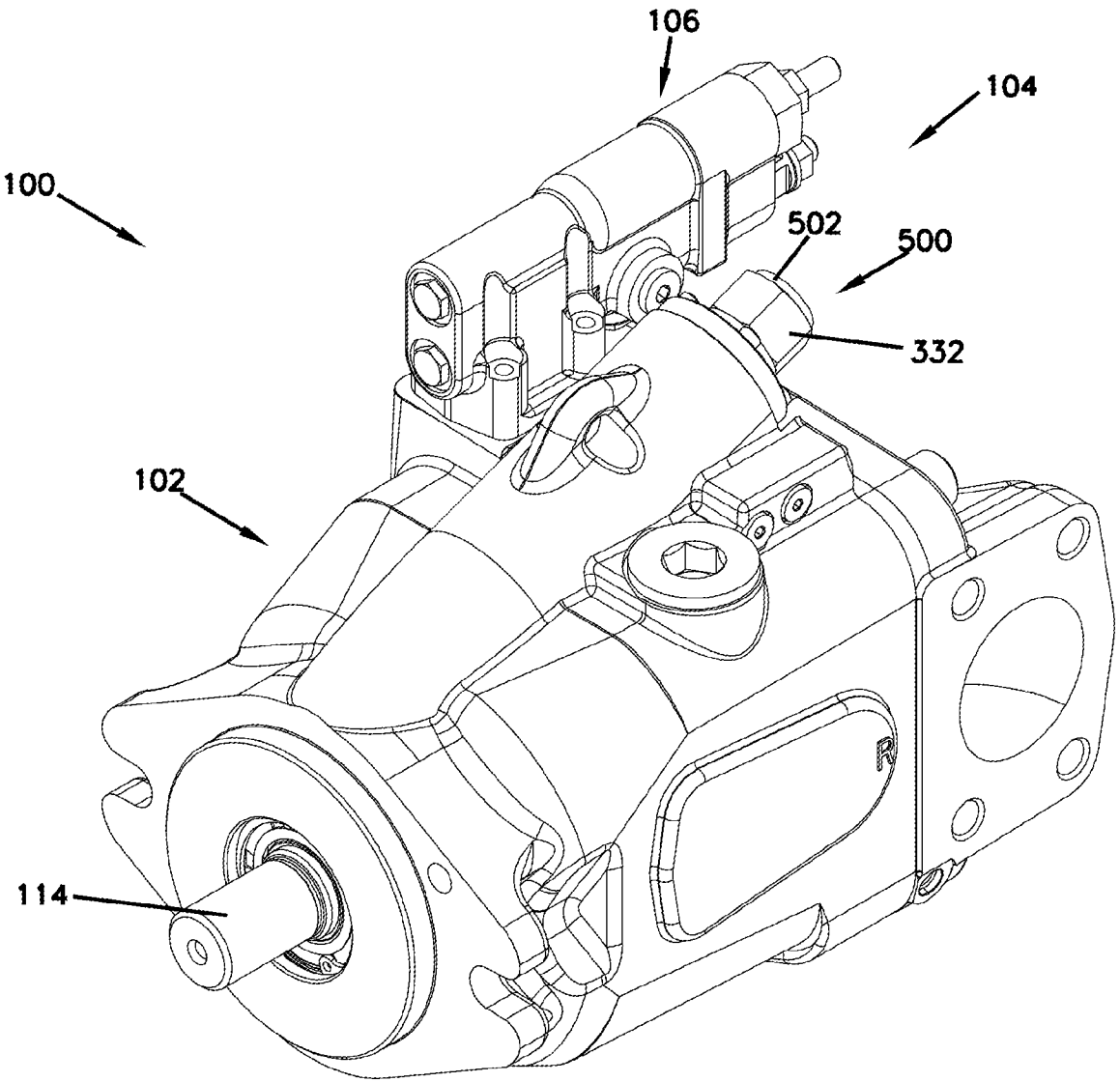
FIG. 12A is a front perspective view of a variable displacement pump system in accordance with yet another exemplary embodiment of the present disclosure.
Figure 12B:
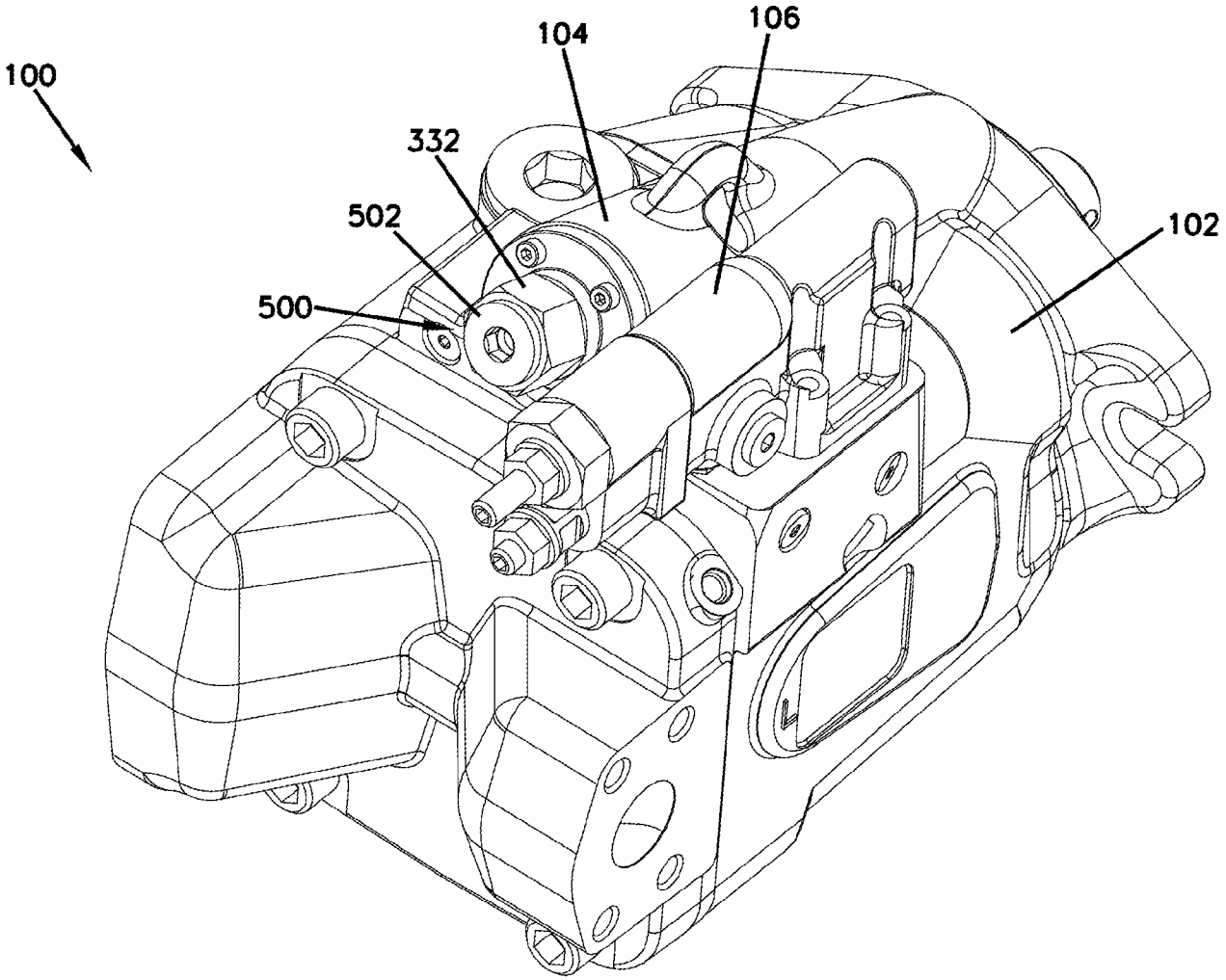
FIG. 12B is a rear perspective view of the variable displacement pump system of FIG. 12A.
Figure 13:
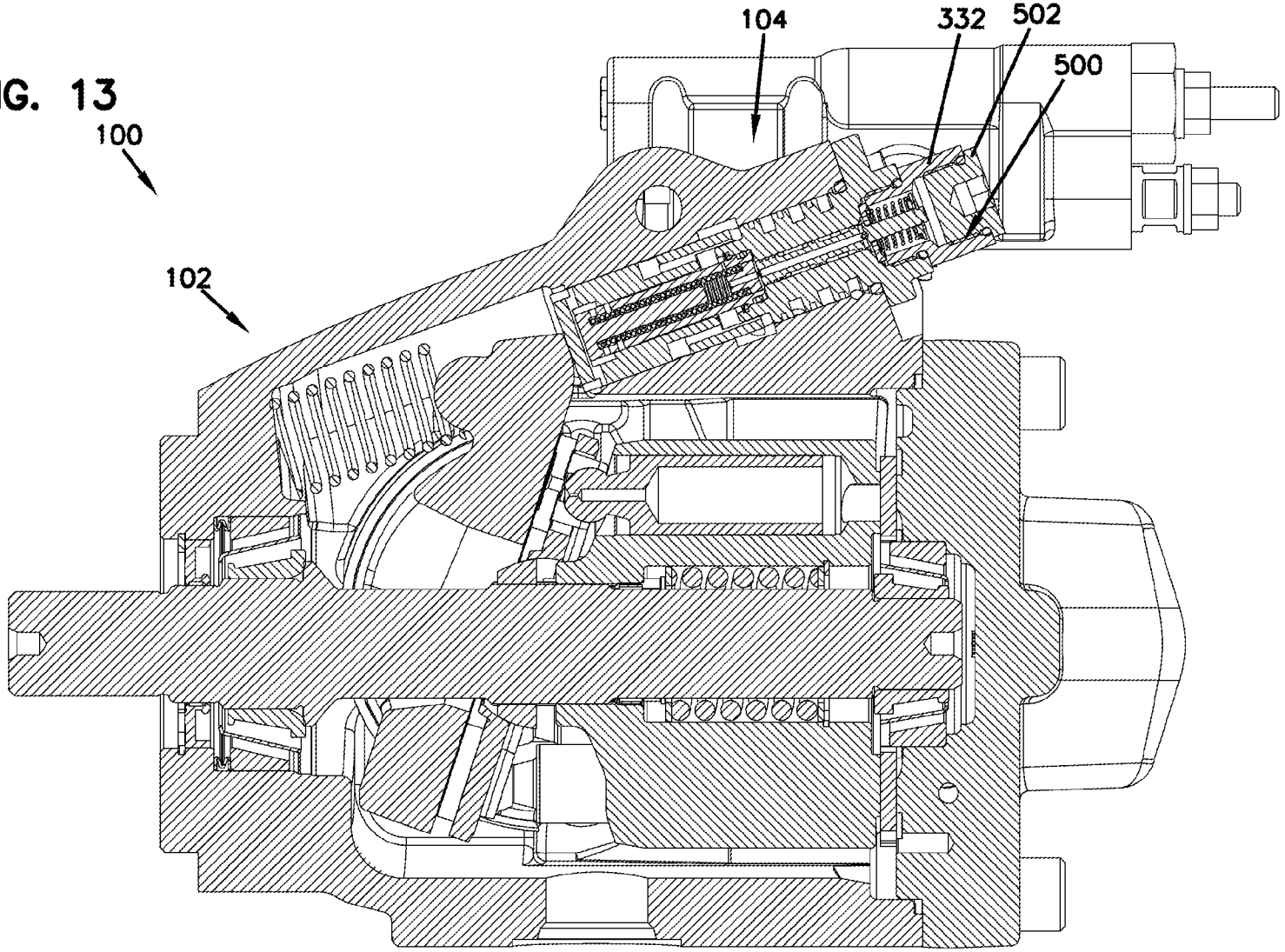
FIG. 13 is a cross-sectional view of the variable displacement pump of FIG. 12A.

Referring to FIGS. 12 and 13, the variable displacement pump system 100 provides a port 500 for receiving the pilot fluid. In some examples, the port 500 is configured to interchangeably fit different types of valve actuation systems 174. For example, the port 500 is adapted to mount either a solenoid actuator or a proportional pressure reducing valve. Such a solenoid actuator can be directly mounted to the port 500 of the system 100, as illustrated in FIGS. 4-6. Such a proportional pressure reducing valve can include a hydraulic hose extending therefrom and having a hose fitting at the free end of the hose, and the hose fitting is engaged with the port 500. As such, the proportional pressure reducing valve can be placed remotely from the variable displacement pump system 100, and thus the variable displacement pump system 100 occupies less space for installation.

As described above, the port 500 is provided with the mounting adapter 322. The mounting adapter 322 can be configured to interchangeably engage different valve actuation systems 174 including the solenoid actuator and a device for providing pilot pressure. As illustrated, the port 500 can be closed with a plug 502 when the system 100 is not in use.

As such, the pump control systems 104 in accordance with the present disclosure can reduce parts or components to implement each of the different examples of the pump control systems 104 above because the pump control systems 104 permits any base pump assembly 102 to be interchangeably used with different types of valve actuation systems 174 (e.g., either a solenoid actuator or a pilot pressure). The pump control system 104 can also be retrofit to existing pump assemblies 102.

Figure 14:
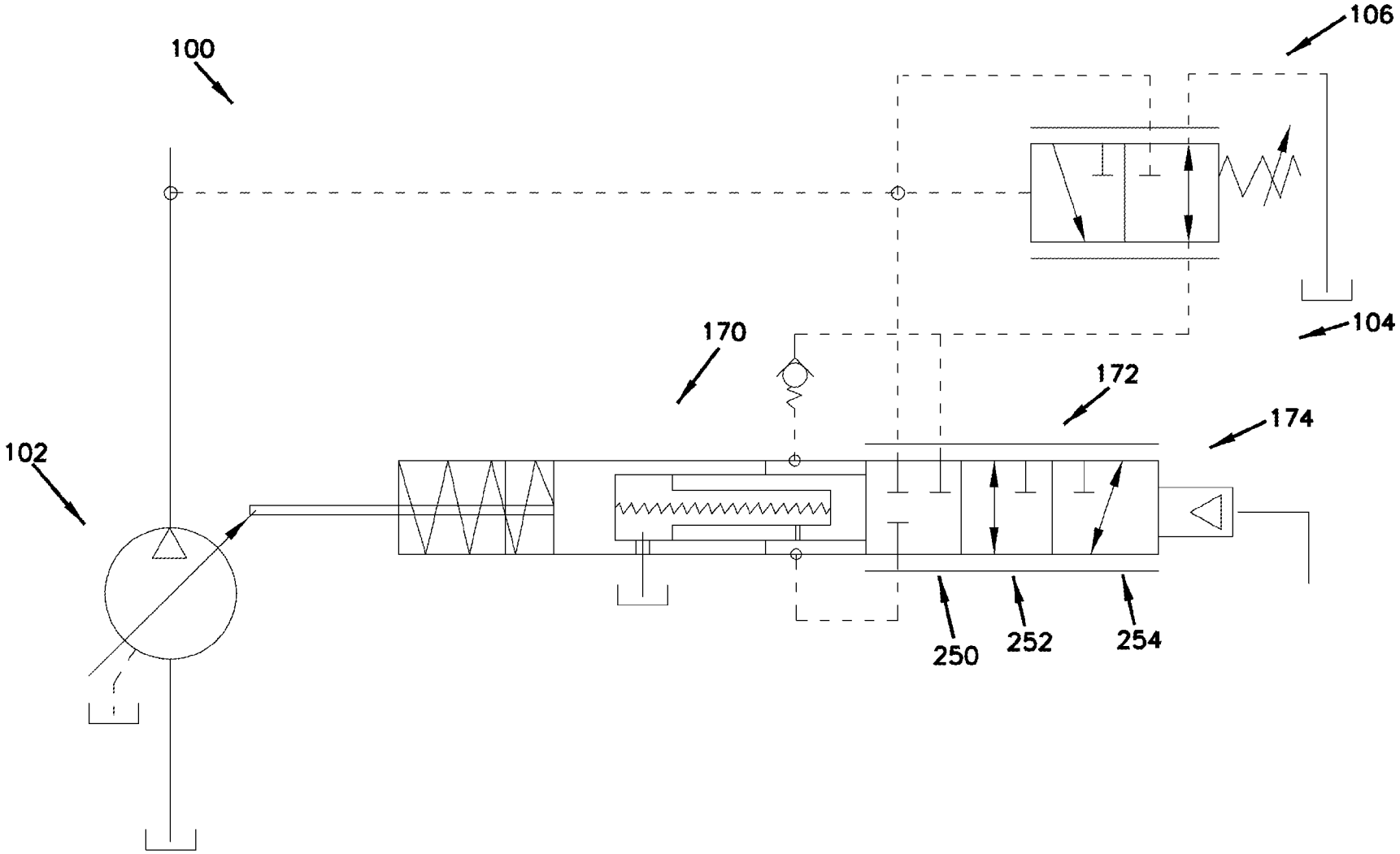
FIG. 14 is a schematic view of the variable displacement pump system of FIG. 12A.

FIG. 14 is a schematic view of the variable displacement pump system 100 utilizing proportional pilot pressure in accordance with an exemplary embodiment of the present disclosure. The system 100 of this example is operated similarly to the system 100 of FIG. 3 except that the solenoid actuator 174 is replaced by a proportional pressure control device. The proportional pressure control device is connected to the port 500 of the system 100 and provides pilot fluid having different pressures. The control valve assembly 172 is movable into the first, second, and third valve positions 250, 252, and 254 as illustrated with reference to FIG. 3. For brevity purposes, the description about the system 100 in FIG. 3 is incorporated by reference for this example, and the configuration and operation of the variable displacement pump system 100 in this example is omitted.

Figure 15:
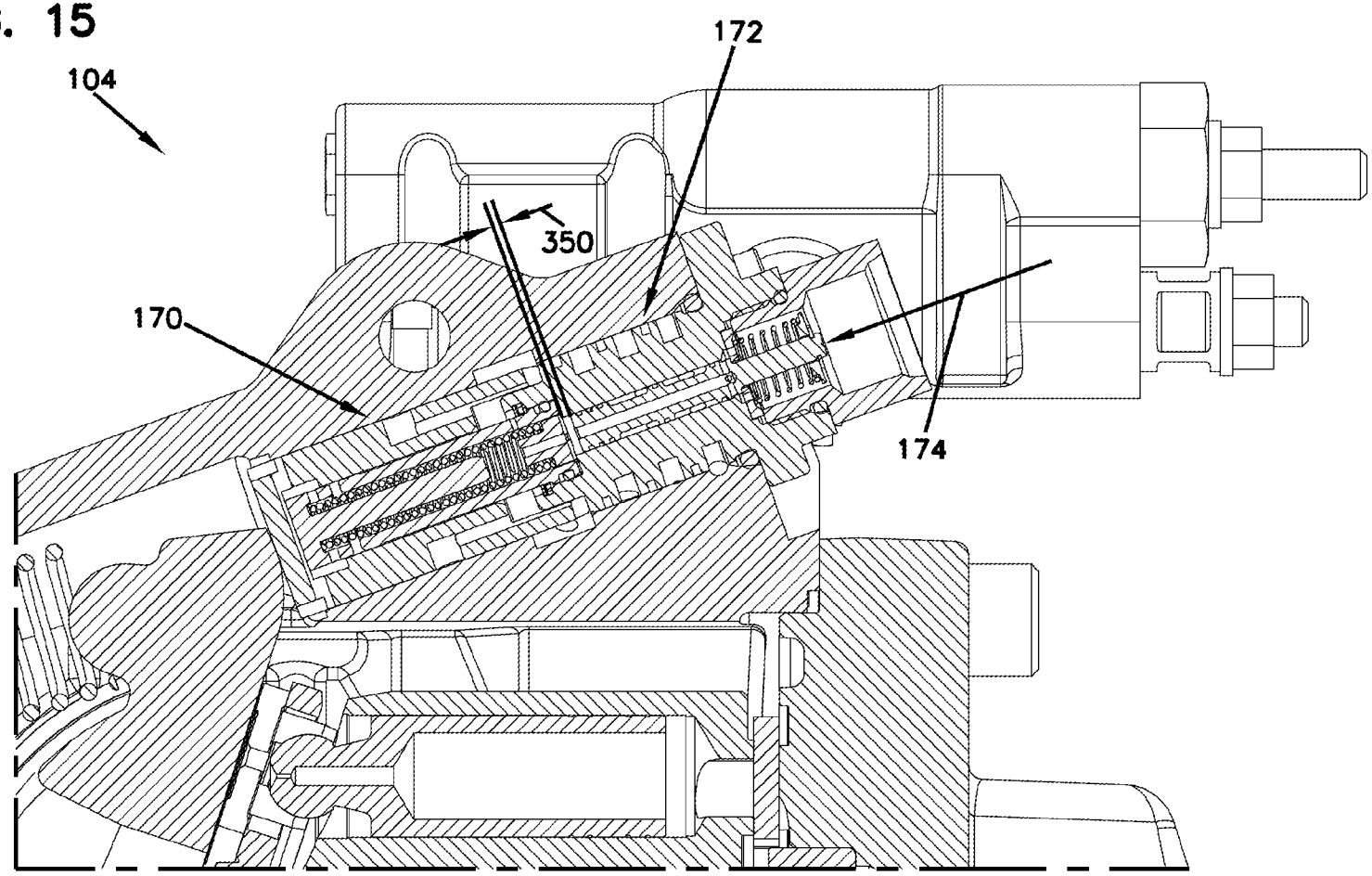
FIG. 15 is a cross-sectional view of a pump control system of the variable displacement pump system of FIG. 14.

Referring to FIG. 15, the valve spool 282 is in the first operating stage as illustrated in FIG. 4. In this example, the valve spool 282 is operated by the proportional pilot pressure that directly acts on the rearward end 288 of the valve spool 282. The axial position of the valve spool 282 is controlled by adjusting the pressure of pilot fluid drawn into the port 500, just as, in the example of FIGS. 3-6, the excitation current is adjusted to control the axial position of the valve spool 282. By changing the pilot pressure, the system 100 is controlled as illustrated with reference to FIGS. 4-6.

Figure 16:
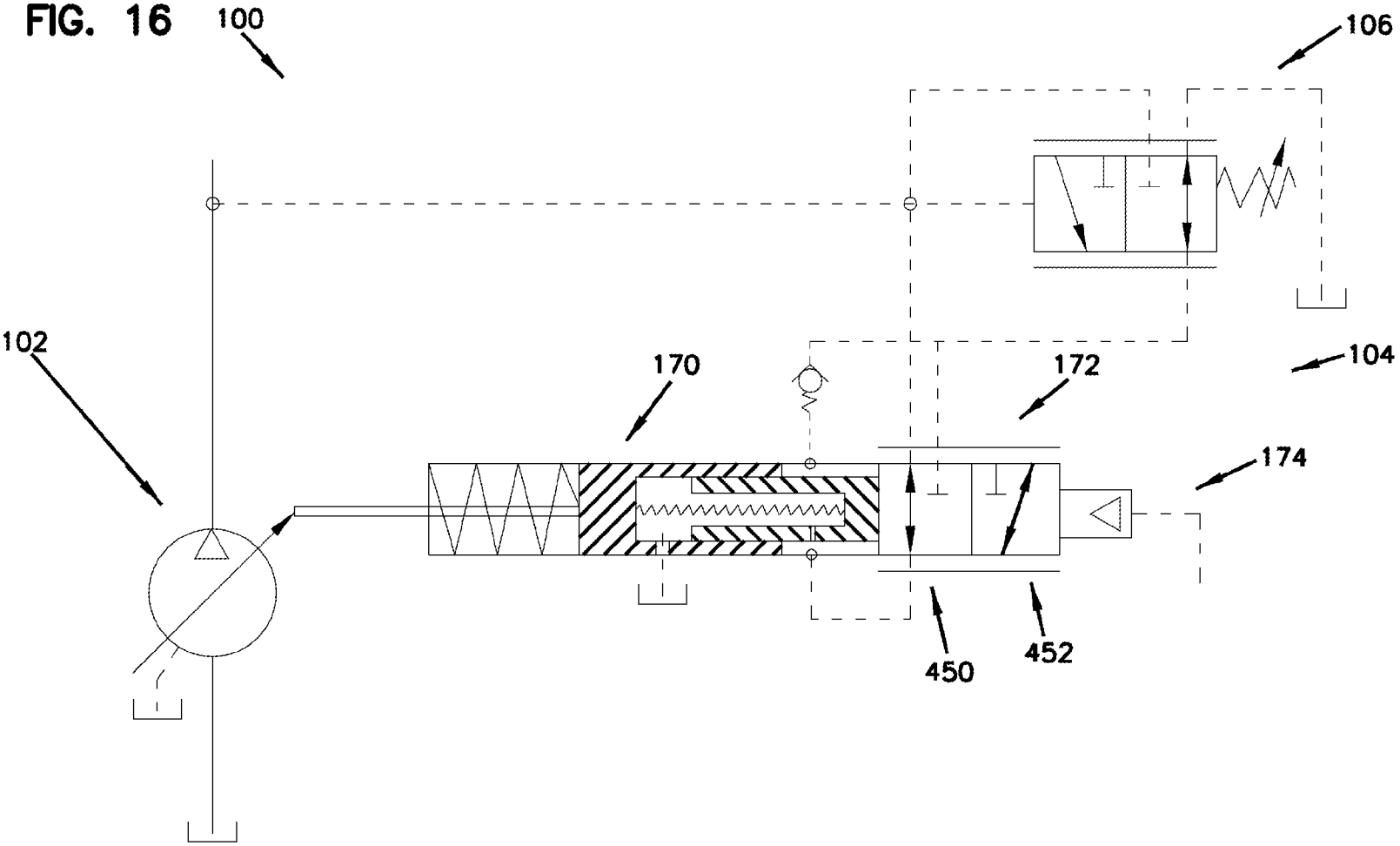
FIG. 16 is a schematic view of a variable displacement pump system in accordance with yet another exemplary embodiment of the present disclosure.

FIG. 16 is a schematic view of the variable displacement pump system 100 utilizing proportional pilot pressure in accordance with another exemplary embodiment of the present disclosure. The system 100 of this example is operated similarly to the system 100 of FIG. 8 except that the solenoid actuator 174 is replaced by a proportional pressure control device. The proportional pressure control device is connected to the port 500 of the system 100 and provides pilot fluid having different pressures. The control valve assembly 172 is movable into the first and second valve positions 450 and 452 as illustrated with reference to FIG. 8. For brevity purposes, the description about the system 100 in FIG. 8 is incorporated by reference for this example, and the configuration and operation of the variable displacement pump system 100 in this example is omitted.

Figure 17:
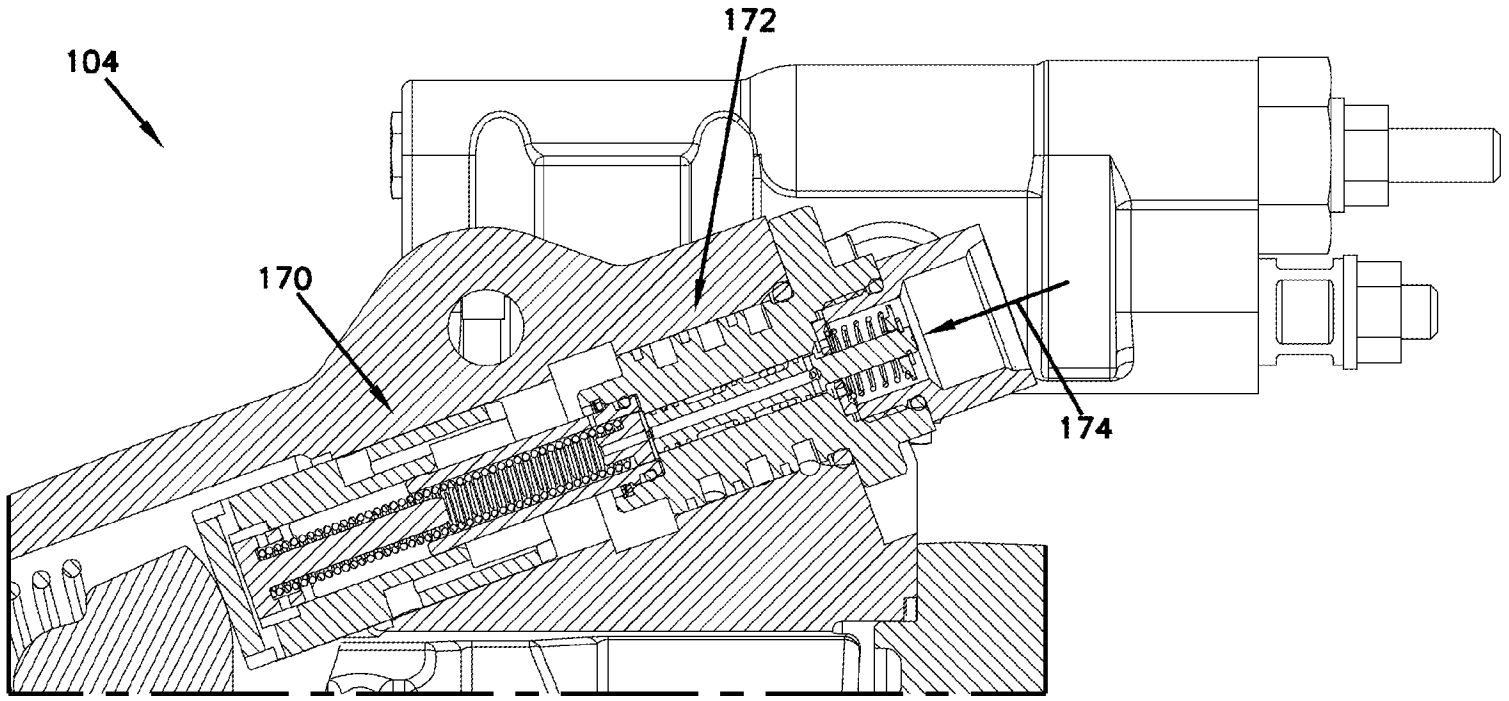
FIG. 17 is a cross-sectional view of a pump control system of the variable displacement pump system of FIG. 16.

Referring to FIG. 17, the valve spool 282 is in the first operating stage as illustrated in FIG. 9. In this example, the valve spool 282 is operated by the proportional pilot pressure that directly acts on the rearward end 288 of the valve spool 282. The axial position of the valve spool 282 is controlled by adjusting the pressure of pilot fluid drawn into the port 500, just as, in the example of FIGS. 9 and 10, the excitation current is adjusted to control the axial position of the valve spool 282. By changing the pilot pressure, the system 100 is controlled as illustrated with reference to FIGS. 9 and 10.

In some examples, the valve spool 282 employed in FIGS. 12-17 does not include the fluid channel 342 so that there is no fluid communication between the forward end 286 of the valve spool 282 and the actuation cavity 320. As such, the pilot pressure can fully act on the rearward end 288 of the valve spool 282 within the actuation cavity 320 without pressurizing the case pressure chamber 214 and/or without leaking to the case volume 220.

The various examples and teachings described above are provided by way of illustration only and should not be construed to limit the scope of the present disclosure. Those skilled in the art will readily recognize various modifications and changes that may be made without following the example examples and applications illustrated and described herein, and without departing from the true spirit and scope of the present disclosure.

What is claimed is:

1. A hydraulic pump system comprising:

a variable displacement pump including:

a pump housing defining a case volume having a case pressure;

a system outlet;

a rotating group mounted within the pump housing and including:

a rotor defining a plurality of cylinders; and a plurality of pistons configured to reciprocate within the cylinders as the rotor is rotated about an axis of rotation to provide a pumping action that directs hydraulic fluid out the system outlet and provides a system outlet pressure to a conduit that defines a system output; and a swash plate configured to be pivoted relative to the axis of rotation to vary stroke length of the pistons and a displacement volume of the pump, the swash plate being movable between a first pump displacement position and a second pump displacement position, the swash plate being biased toward the first pump displacement position;

a control system for controlling a pump displacement position of the swash plate, the control system at least partially mounted within a bore of the pump housing, the bore having a longitudinal axis, the control system including:

a control piston assembly including:

a piston guide tube having a first tube end and a second tube end and defining a hollow portion within the piston guide tube extending between the first and second tube ends along the longitudinal axis within the bore; and a control piston at least partially mounted in the bore and movable along the longitudinal axis, the control piston having a first piston end adapted to receive a biasing force from the swash plate and a second piston end adapted to receive a displacement control force generated by a control pressure that acts on the second piston end of the control piston, the biasing force and the displacement control force being in opposite directions along the longitudinal axis, the control piston including a piston hole defined therewithin and at least partially receiving the piston guide tube to define a case pressure chamber with the hollow portion of the piston guide tube, the case pressure chamber being in fluid communication with the case volume; and a control valve assembly for controlling the control pressure supplied to the second piston end of the control piston, the control valve assembly operable to enable the second piston end of the control piston to be selectively in fluid communication with the case volume and the system output.

2. The hydraulic pump system according to claim 1, wherein the control system further includes a valve actuation system controlling the control valve assembly.

3. The hydraulic pump system according to claim 2, wherein the valve actuation system is moved by a pilot pressure.

4. The hydraulic pump system according to claim 1, wherein the control piston assembly includes:

a spring seat disposed at the second tube end of the piston guide tube and movable along the longitudinal axis relative to the piston guide tube; and a feedback spring disposed between the spring seat and the first piston end of the control piston within the control piston assembly and biasing the spring seat toward the second tube end of the piston guide tube.

5. The hydraulic pump system according to claim 4, wherein the control piston assembly includes:

a spring guide extending from the first piston end of the control piston toward the spring seat along the longitudinal axis such that the feedback spring is disposed around the spring guide.

6. The hydraulic pump system according to claim 1, wherein the control piston assembly includes:

a control pressure chamber within which the control pressure is applied on the second piston end of the control piston, the control pressure chamber being selectively in fluid communication with the case volume and the system output; and an orifice provided in the piston guide tube and defined between the control pressure chamber and the case pressure chamber.

7. The hydraulic pump system according to claim 1, wherein the control valve assembly includes:

a valve housing at least partially mounted to the bore of the pump housing and defines a valve bore along the longitudinal axis; and a valve spool configured to slide within the valve bore along the longitudinal axis to control a magnitude of the control pressure supplied to the second piston end of the control piston, the valve spool having a forward end configured to move the spring seat against a biasing force of the feedback spring along the longitudinal axis and a rearward end driven by valve actuation system.

8. The hydraulic pump system according to claim 7, wherein the valve housing has a first housing end and a second housing end, the first housing end attached to the second tube end of the piston guide tube and including a position stop configured to stop the movement of the spring seat toward the valve spool along the longitudinal axis, and the second housing end configured to mount to the valve actuation system.

9. The hydraulic pump system according to claim 8, wherein the valve housing includes an actuation cavity defined at the second housing end, wherein the rearward end of the valve spool extends to the actuation cavity to engage the valve actuation system within the actuation cavity.

10. The hydraulic pump system according to claim 9, wherein the control valve assembly includes a spool biasing member configured to bias the valve spool toward the second housing end of the valve housing.

11. The hydraulic pump system according to claim 7, wherein the spring seat includes a fluid channel defined therewithin and providing fluid communication between the case pressure chamber and the forward end of the valve spool.

12. The hydraulic pump system according to claim 11, wherein the valve spool includes a fluid channel defined therewithin and providing fluid communication between the forward end of the valve spool and the actuation cavity such that the case pressure chamber of the control piston assembly is in fluid communication with the forward end of the valve spool and the actuation cavity.

13. The hydraulic pump system according to claim 7, wherein the valve spool is movable among a first position, a second position, and a third position, the valve spool being biased to the first position when the valve actuation system is not in operation, and the valve actuation system operable to move the valve spool from the first position to the second position and from the second position to the third position;

wherein, when the valve spool is in the first position, the forward end of the valve spool is spaced apart from the spring seat at a predetermined distance and the spring seat is seated on the position stop of the valve housing and the second piston end of the control piston is in fluid communication with the case volume;

wherein, as the valve spool is driven from the first position to the second position, the forward end of the valve spool moves toward the spring seat, and the second piston end of the control piston becomes in fluid communication with the system output such that the control pressure applied on the second piston end of the control piston increases to move the control piston against the biasing force of the swash plate, thereby moving the swash plate toward the second pump displacement position; and wherein, as the valve spool is driven from the second position to the third position, the forward end of the valve spool moves the spring seat against the biasing force of the feedback spring, and the second piston end of the control piston becomes in fluid communication with the case volume such that the control pressure applied on the second piston end of the control piston decreases to permit the biasing force of the swash plate to move the control piston back.

14. The hydraulic pump system according to claim 7, wherein the valve spool is driven by the valve actuation system between a first position and a second position, the valve spool being biased to the first position when the valve actuation system is not in operation;

wherein, when the valve spool is in the first position, the second piston end of the control piston is in fluid communication with the system output such that the control pressure applied on the second piston end of the control piston is adapted to move the control piston against the biasing force of the swash plate and maintain the swash plate to the second pump displacement position; and wherein, as the valve spool is driven from the first position to the second position, the forward end of the valve spool moves the spring seat against the biasing force of the feedback spring, and the second piston end of the control piston becomes in fluid communication with the case volume such that the control pressure applied on the second piston end of the control piston decreases to permit the biasing force of the swash plate to move the control piston back.

15. The hydraulic pump system according to claim 7, wherein the valve housing of the control valve assembly is at least partially slid into the bore of the pump housing and fastened to the pump housing with one or more fasteners.

16. The hydraulic pump system according to claim 15, wherein an axial length of the control piston assembly is configured to be longer in the longitudinal axis than an axial length of the control valve assembly.

17. The hydraulic pump system according to claim 8, wherein the valve housing has a recessed portion at the first housing end, the recessed portion configured to receive and secure the second tube end of the piston guide tube, and the recessed portion including the position stop.

18. The hydraulic pump system according to claim 17, wherein a sealing element is disposed between the second tube end of the piston guide tube and the first housing end of the valve housing, and the second tube end of the piston guide tube is fastened in the recessed portion of the valve housing with a snap ring.

19. A variable displacement pump system comprising:

a variable displacement pump including:

a pump housing defining a case volume having a case pressure;

a system outlet having a system pressure;

a rotating group mounted within the pump housing and including:

a rotor defining a plurality of cylinders; and a plurality of pistons configured to reciprocate within the cylinders as the rotor is rotated about an axis of rotation to provide a pumping action that directs hydraulic fluid out the system outlet and provides the system pressure; and a swash plate configured to be pivoted relative to the axis of rotation to vary stroke length of the pistons and a displacement volume of the pump, the swash plate being movable between a maximum displacement position and a minimum displacement position, the swash plate being biased toward the maximum displacement position; and a control system including:

a control piston assembly including an axially movable control piston, the control piston having a first piston end adapted to receive a biasing force from the swash plate and a second piston end adapted to receive a displacement control force generated by a control pressure that acts on the second piston end of the control piston, the biasing force and the displacement control force being in opposite directions along the longitudinal axis; and a control valve assembly movable to a first valve position, a second valve position, and a third valve position, wherein, in the first valve position, the second piston end of the control piston is in fluid communication with the case volume, wherein, in the second valve position, the second piston end of the control piston is in fluid communication with the system pressure such that the control pressure applied on the second piston end of the control piston increases to move the control piston against the biasing force of the swash plate, thereby moving the swash plate toward the minimum displacement position, and wherein, in the third valve position, the second piston end of the control piston is in fluid communication with the case volume such that the control pressure applied on the second piston end of the control piston decreases to permit the biasing force of the swash plate to move the control piston back;

wherein: the control piston assembly further includes:

a piston guide tube having a first tube end and a second tube end and extending between the first and second tube ends along the longitudinal axis within a bore of the pump housing and defining a hollow portion within the piston guide tube, the bore having a longitudinal axis;

a spring seat disposed at the second tube end of the piston guide tube and movable along the longitudinal axis relative to the piston guide tube; and a feedback spring disposed between the spring seat and the first piston end of the control piston within the hollow portion of the control piston assembly and biasing the spring seat toward the second tube end of the piston guide tube.

20. The variable displacement pump system according to claim 19, wherein:

the control valve assembly further includes:

a valve housing at least partially mounted to the bore of the pump housing and defines a valve bore along the longitudinal axis, the valve housing configured to mount a valve actuation system;

a valve spool configured to slide within the valve bore along the longitudinal axis and having a forward end configured to move the spring seat against a biasing force of the feedback spring along the longitudinal axis and a rearward end driven by the valve actuation system, the valve spool biased away from the spring seat; and a position stop configured to stop movement of the spring seat toward the valve spool along the longitudinal axis at the first valve position such that a gap is defined between the spring seat and the forward end of the valve spool at the first valve position.

* * * * *